US010087873B2

(12) United States Patent
Ikemoto

(10) Patent No.: US 10,087,873 B2
(45) Date of Patent: Oct. 2, 2018

(54) CONTROL SYSTEM FOR INTERNAL COMBUSTION ENGINE

(71) Applicant: TOYOTA JIDOSHA KABUSHIKI KAISHA, Toyota-shi, Aichi-ken (JP)

(72) Inventor: Masato Ikemoto, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/633,963

(22) Filed: Jun. 27, 2017

(65) Prior Publication Data

US 2018/0003124 A1 Jan. 4, 2018

(30) Foreign Application Priority Data

Jun. 29, 2016 (JP) ..... 2016-128689

(51) Int. Cl.

*F02D 41/38* (2006.01)
*F02M 47/02* (2006.01)
*F02M 61/10* (2006.01)
*F02M 63/02* (2006.01)

(52) U.S. Cl.

CPC ..... *F02D 41/3836* (2013.01); *F02M 47/02* (2013.01); *F02M 61/10* (2013.01); *F02M 63/0225* (2013.01); *F02D 2041/389* (2013.01)

(58) Field of Classification Search

CPC ..... F02D 41/3836; F02D 2041/389; F02M 63/0225; F02M 61/10; F02M 47/02

See application file for complete search history.

(56) References Cited

U.S. PATENT DOCUMENTS

2002/0073973 A1* 6/2002 Desai ..... F02M 45/00 123/499
2006/0054149 A1* 3/2006 Uchiyama ..... F02D 41/222 123/676
2006/0202053 A1* 9/2006 Gibson ..... F02M 47/027 239/88
2009/0164103 A1 6/2009 Matsumoto et al.
2010/0192910 A1* 8/2010 Toyoshima ..... F02D 41/222 123/456

(Continued)

FOREIGN PATENT DOCUMENTS

JP 2005-256703 A 9/2005
JP 2009-156045 A 7/2009
WO WO 2009093344 A1 * 7/2009 ..... F02D 41/3845

*Primary Examiner* — Joseph Dallo
(74) *Attorney, Agent, or Firm* — Hunton Andrews Kurth LLP

(57) ABSTRACT

An internal combustion engine includes a plurality of cylinders, a plurality of fuel injection valves, a control chamber provided in each of the fuel injection valves. A control system for the internal combustion engine includes an electronic control unit which is configured to (i) reduce a pressure of the fuel in the control chamber to be lower than a pressure of the fuel in the fuel passage connected to the control chamber, in each of the fuel injection valves, (ii) reduce the pressure of the fuel such that a first pressure difference is equal to or larger than a predetermined pressure difference, so as to move the needle in a direction to open the injection holes, and (iii) reduce the reference pressure by reducing the pressure of the fuel in a second injection valve, such that the first pressure difference after operation is smaller than the predetermined pressure difference.

3 Claims, 11 Drawing Sheets

(56) References Cited

U.S. PATENT DOCUMENTS

| | | | | |
|---|---|---|---|---|
| 2010/0206269 | A1* | 8/2010 | Cinpinski | F02D 41/3854 123/456 |
| 2011/0259286 | A1* | 10/2011 | Firey | F02B 45/00 123/23 |
| 2011/0295490 | A1* | 12/2011 | Tsuji | F02D 41/3011 701/103 |
| 2014/0001290 | A1* | 1/2014 | Nishida | F02M 61/10 239/585.1 |
| 2016/0177860 | A1* | 6/2016 | Pursifull | F02D 41/0025 123/294 |
| 2016/0258404 | A1* | 9/2016 | Tanada | F02M 61/045 |
| 2017/0276108 | A1* | 9/2017 | Takase | F02B 75/20 |

* cited by examiner (a):EXECUTION OF PRESSURE INCREASE BY PRESSURE INCREASING DEVICE
(b):END OF PRESSURE INCREASE BY PRESSURE INCREASING DEVICE (a):EXECUTION OF PRESSURE INCREASE BY PRESSURE INCREASING DEVICE
(b):END OF PRESSURE INCREASE BY PRESSURE INCREASING DEVICE

CONTROL SYSTEM FOR INTERNAL COMBUSTION ENGINE

INCORPORATION BY REFERENCE

The disclosure of Japanese Patent Application No. 2016-128689 filed on Jun. 29, 2016 including the specification, drawings and abstract is incorporated herein by reference in its entirety.

BACKGROUND

1. Technical Field

The present disclosure relates to a control system for an internal combustion engine.

2. Description of Related Art

In a compression ignition internal combustion engine, or the like, in which fuel is directly injected into cylinders, the fuel injection rate has influence on combustion (e.g., diffusion combustion) of the fuel injected into the cylinders.

With regard to the internal combustion engine as described above, a technology of increasing the fuel injection rate during fuel injection after once reducing it is disclosed (see Japanese Patent Application Publication No. 2009-156045 (JP 2009-156045 A)). According to this technology, the fuel injection rate is changed by changing the lift amount of a needle of a fuel injection valve.

Also, a fuel injection valve is known which includes an electromagnetic valve that opens and closes a return pathway through which high-pressure fuel supplied from a common rail to the fuel injection valve overflows into a low-pressure stage of a fuel system. The fuel injection valve performs fuel injection, by causing the high-pressure fuel to overflow into the low-pressure stage of the fuel system so as to drive a needle. Here, it is known to cause the high-pressure fuel to overflow into the low-pressure stage of the fuel system, before performing fuel injection, by performing blank driving of the electromagnetic valve, namely, by driving the needle for a shorter duration than that required for the needle to open the fuel injection valve (see Japanese Patent Application Publication No. 2005-256703 (JP 2005-256703 A)).

SUMMARY

In the compression ignition internal combustion engine, or the like, when the fuel injection rate in the initial stage of fuel injection is low, the amount of smoke generated in the cylinder during combustion may be increased. On the other hand, when the fuel injection rate in the later stage of fuel injection is high, fuel spray may excessively diffuse, and a cooling loss may be increased due to combustion flame that spreads to the vicinity of a wall of the cylinder. Accordingly, it is desirable that the fuel injection rate is relatively high in the initial stage of fuel injection, and is relatively low in the later stage. This pattern of the fuel injection rate will be called "pattern of initial high injection rate and later low injection rate".

With the known technology (e.g., JP 2009-156045 A) of changing the fuel injection rate, the fuel injection rate during fuel injection is once reduced by changing the lift amount of the needle of the fuel injection valve, but is subsequently increased; therefore, the fuel injection rate in the later stage of fuel injection becomes relatively high.

With the known technology (e.g., JP 2005-256703 A) that does not depend on control of the lift amount of the needle of the fuel injection valve, the fuel injection pressure at the start of fuel injection can be adjusted, but the fuel injection rate during fuel injection, in particular, in the later stage of fuel injection, is not controlled.

Thus, the known technologies cannot realize fuel injection having the pattern of the initial high injection rate and later low injection rate, as a pattern of fuel injection rate found by the inventor of this disclosure for suppressing the amount of smoke generated and reducing the cooling loss.

This disclosure provides a control system for an internal combustion engine, which suppresses generation of smoke in each cylinder in the initial stage of fuel injection, and minimizes a cooling loss in the later stage of fuel injection.

According to one aspect of the disclosure, a control system for an internal combustion engine is provided with the internal combustion engine which includes a plurality of cylinders, a plurality of fuel injection valves, a high-pressure pump, a common rail, a plurality of fuel passages, and a control chamber. The plurality of fuel injection valves are provided in the plurality of cylinders, respectively. Each of the plurality of fuel injection valves is configured to directly inject a fuel into a corresponding one of the cylinders by moving a needle and opening injection holes. The high-pressure pump is configured to increase a pressure of the fuel and feed the fuel under pressure. The common rail is configured to store the fuel having a reference pressure to which the pressure of the fuel is increased by the high-pressure pump. The plurality of fuel passages are provided independently of each other, and each of the fuel passages extends from the common rail to the injection holes of a corresponding one of the plurality of fuel injection valves. The control chamber is provided in each of the plurality of fuel injection valves, and is connected to a corresponding one of the fuel passages which leads to the injection holes of the corresponding fuel injection valve. The control system is provided with an electronic control unit. The electronic control unit is configured to: (i) reduce a pressure of the fuel in the control chamber to be lower than a pressure of the fuel in the fuel passage connected to the control chamber, in each of the plurality of fuel injection valves, (ii) move the needle in a direction to open the injection holes by reducing the pressure of the fuel such that a first pressure difference as a pressure difference between the pressure of the fuel in the control chamber and the pressure of the fuel in the fuel passage connected to the control chamber is equal to or larger than a predetermined pressure difference, in each of the plurality of fuel injection valves, so as to move the needle in a direction to open the injection holes, and (iii) reduce the reference pressure by executing pressure reducing operation in a second injection valve, such that the first pressure difference after operation is smaller than the predetermined pressure difference, during fuel injection by a first injection valve, and after a lapse of a predetermined period from start of fuel injection by the first injection valve. The first injection valve is one of the plurality of the fuel injection valves which is currently injecting the fuel, and the second injection valve is at least one of the plurality of fuel injection valves which is different from the first injection valve.

In each of the fuel injection valves, in a condition where the pressure of the fuel in the control chamber is not reduced, the pressure of the fuel in the control chamber is equal to the pressure of the fuel in the fuel passage, and, in this condition, the injection holes are closed by the needle. At this time, the force applied to the needle in the valve closing direction is larger than that in the valve opening direction. If the pressure of the fuel in the control chamber is reduced, the pressure of the fuel in the control chamber becomes lower than the pressure of the fuel in the fuel passage, and the force applied to the needle in the valve closing direction is reduced. Then, if the force applied to the needle in the valve opening direction becomes larger than the force applied to the needle in the valve closing direction, namely, if the first pressure difference becomes equal to or larger than the predetermined pressure difference, the needle is moved to open the injection holes, so that the fuel is injected.

The pressure of the fuel in the control chamber is reduced, so as to reduce the force applied to the needle in the valve closing direction. Since the control chamber communicates with the fuel passage, the pressure reduction of the fuel in the control chamber results in subsequent reduction of the pressure of the fuel in the fuel passage. Further, since the fuel passage communicates with the common rail, the pressure reduction of the fuel in the fuel passage results is subsequent reduction of the reference pressure as the pressure of the fuel in the common rail. Here, if the pressure of the fuel in the control chamber is reduced such that the first pressure difference as the pressure difference between the pressure of the fuel in the fuel passage and the pressure of the fuel in the control chamber is smaller than the predetermined pressure difference, the pressure of the fuel in the control chamber can be reduced without actually injecting fuel from the fuel injection valve. If the pressure of the fuel in the control chamber is reduced in this manner, the reference pressure is reduced. The predetermined pressure difference may be said to be a pressure difference with which the needle starts moving.

Thus, the electronic control unit performs the pressure reduction in the second injection valve, such that the first pressure difference after the reduction is smaller than the predetermined pressure difference, in the second injection valve, during fuel injection by the first injection valve, and after the lapse of the predetermined period from the start of fuel injection by the first injection valve. Here, the pressure reducing operation performed by the electronic control unit will be called "blank operation" since the pressure of the fuel in the control chamber is reduced within a range in which the needle is not moved. If the blank operation is performed, the pressure of the fuel in the control chamber provided in the second injection valve is reduced, during fuel injection by the first injection valve. As a result, the reference pressure is reduced, during fuel injection by the first injection valve.

The reference pressure and the fuel injection rate are correlated with each other such that the fuel injection rate is reduced as the reference pressure is reduced. Therefore, as the reference pressure is reduced during fuel injection by the first injection valve, the fuel injection rate during fuel injection by the first injection valve is reduced.

Also, the blank operation is performed after the lapse of the predetermined period from the start of the fuel injection by the first injection valve, so that the fuel injection rate is reduced at a desired point in time during fuel injection by the first injection valve, namely, the fuel injection rate is reduced at a desired point in time in the later stage of fuel injection. In other words, the predetermined period is defined as a period in which the fuel injection rate can be reduced in the above manner.

According to the control system for the internal combustion engine as described above, the fuel injection rate can be reduced at the desired point in time in the later stage of fuel injection, so that the fuel injection having the above pattern of the initial high injection rate and the later low injection rate can be realized. Thus, generation of smoke in the cylinder in the initial stage of fuel injection can be suppressed, and the cooling loss in the later stage of fuel injection can be minimized.

If the blank operation is performed in the second injection valve, the first pressure difference arises between the pressure of the fuel in the control chamber of the second injection valve and the pressure of the fuel in the fuel passage connected to the control chamber. Then, the fuel in the fuel passage flows into the control chamber due to the first pressure difference, and the pressure of the fuel in the fuel passage is reduced due to the flow of the fuel into the control chamber. Then, the pressure reduction propagates through the fuel in the fuel passage, and further propagates through the fuel in the common rail that communicates with the fuel passage. Here, if the pressure reduction reaches a connecting portion between the fuel passage that leads to the first injection valve, and the common rail, the pressure reduction propagates from the connecting portion to the first injection valve via the fuel passage, and, consequently, the fuel injection rate during fuel injection by the first injection valve starts being reduced. Accordingly, the start time of reduction of the fuel injection rate is advanced when the pressure reduction caused by the blank operation reaches the connecting portion earlier, and the start time of reduction of the fuel injection rate is delayed when the pressure reduction reaches the connecting portion later. When a certain period elapses after the blank operation is performed, the pressures of the fuel in the control chamber, fuel passage, and the common rail are brought into an equilibrium condition to be equal to a pressure that is lower than the reference pressure.

The control system for the internal combustion engine may further include a first connecting portion and a second connecting portion. The first connecting portion may be configured to connect the fuel passage that leads to the injection holes of the first injection valve, with the common rail. The second connecting portion may be configured to connect the fuel passage that leads to the injection holes of the second injection valve, with the common rail. The electronic control unit may be configured to: (i) control start time of the pressure reducing operation in the second injection valve, according to a distance between the first connecting portion and the second connecting portion, and (ii) delay the start time of the pressure reducing operation, to be later when the distance between the first connecting portion and the second connecting portion is shorter, than that when the distance between the first connecting portion and the second connecting port is longer.

According to the control system for the internal combustion engine, the time of reduction of the fuel injection rate during fuel injection by the first injection valve can be controlled with relatively high accuracy.

The control system for the internal combustion engine may further include a pressure increasing device provided in each of the plurality of fuel passages. The pressure increasing device may be configured to increase the pressure of the fuel supplied from the common rail to a corresponding one of the plurality of fuel injection valves.

According to the control system for the internal combustion engine, the pressure increasing device as described above is provided, so that the fuel injection pressure can be increased to a relatively high level. Since the blank operation cannot increase the fuel injection rate though it can reduce the fuel injection rate, the provision of the pressure increasing device makes it possible to increase the fuel injection rate in the initial stage of fuel injection, in particular. In this case, the fuel injection rate in the later stage is reduced through blank operation. Namely, the pressure increasing device makes it possible to favorably suppress generation of smoke in the cylinder in the initial stage of fuel injection.

According to the disclosure, the fuel injection rate can be controlled into the pattern of the initial high injection rate and later low injection rate. Accordingly, generation of smoke in the cylinder in the initial stage of fuel injection can be suppressed, and a cooling loss in the later stage of fuel injection can be minimized.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Some embodiments of the disclosure will be described in detail with reference to the drawings. It is, however, to be understood that the dimensions, materials, shapes, relative positions, etc. of constituents components described in the embodiments are not supposed to limit the scope of the disclosure to these details, unless otherwise particularly stated.

Figure 1:
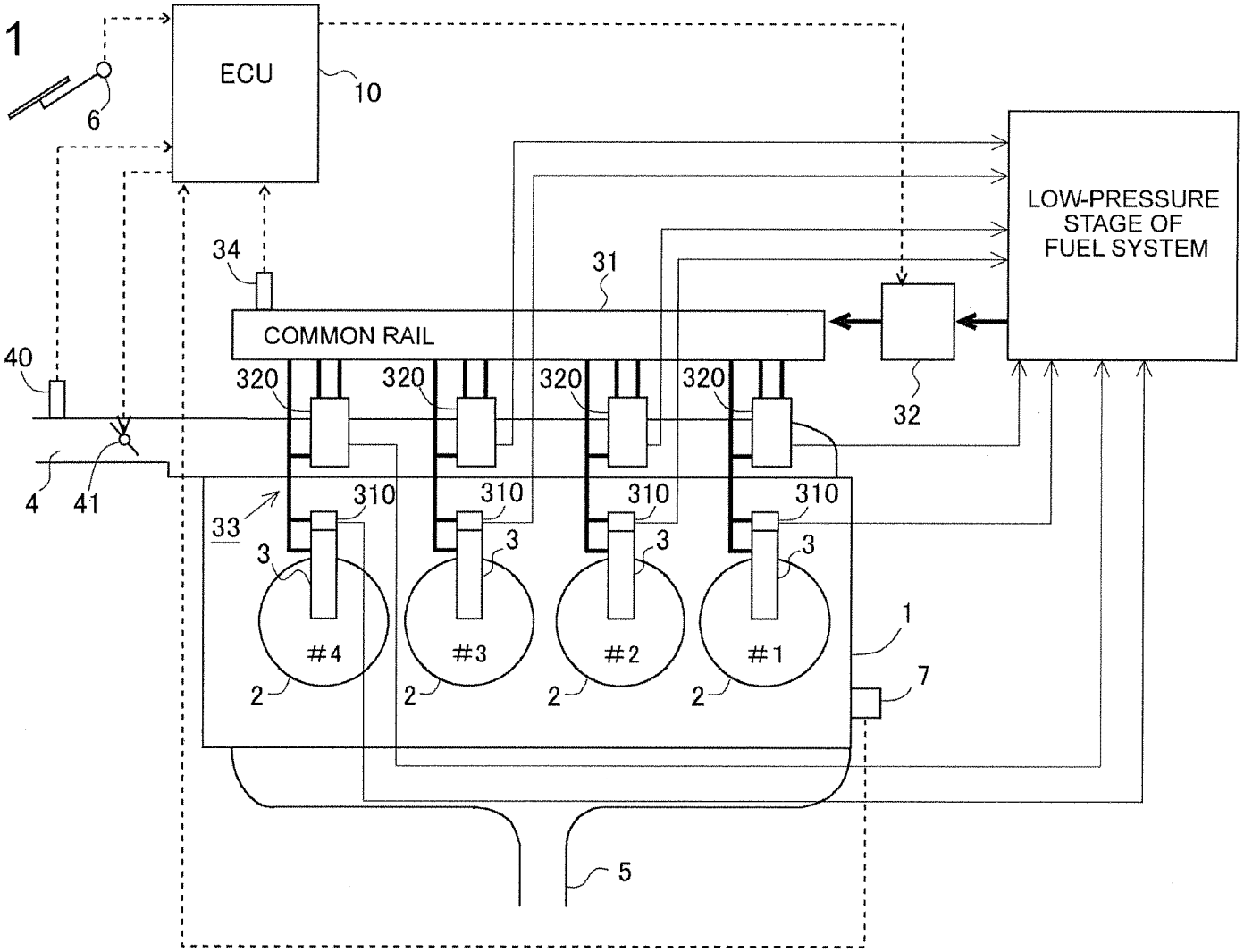
FIG. 1 is a view showing the general configuration of an internal combustion engine, its intake and exhaust systems, and its fuel system, according to one embodiment of the disclosure.

One embodiment of the disclosure will be described using the drawings. FIG. 1 shows the general configuration of an internal combustion engine, its intake and exhaust systems, and its fuel system according to this embodiment. The internal combustion engine 1 shown in FIG. 1 is a compression ignition type internal combustion engine (diesel engine) including four cylinders 2. In each of the cylinders 2, a fuel injection valve 3 for directly injecting fuel into the cylinder 2 is provided.

An intake passage 4 and an exhaust passage 5 are connected to the internal combustion engine 1. An air flow meter 40 and a throttle valve 41 are provided in the intake passage 4. The air flow meter 40 outputs an electric signal corresponding to the amount (mass) of intake air (air) flowing in the intake passage 4. The throttle valve 41 is located downstream of the air flow meter 40 in the intake passage 4. The throttle valve 41 adjusts the intake air amount of the engine 1, by changing the passage cross-sectional area of the intake passage 4. The exhaust passage 5 is open to the atmosphere, via a catalyst and a muffler (not shown).

The internal combustion engine 1 is provided with a common rail 31 that stores high-pressure fuel. The common rail 31 is connected to a high-pressure pump 32 that is driven by the engine 1 so as to raise the pressure of the fuel to a high level and feed the fuel under pressure, and the common rail 31 stores the fuel having a reference pressure to which the fuel pressure has been raised by the high-pressure pump 32. The common rail 31 supplies the fuel having the reference pressure to each fuel injection valve 3 via each fuel passage 33. The common rail 31 is provided with a pressure sensor 34 that detects the reference pressure.

The high-pressure pump 32 is a plunger-type pump, for example. A camshaft (not show) provided in the engine 1 has a cam lobe for driving the high-pressure pump 32. The high-pressure pump 32 is driven by the cam lobe during operation of the engine 1, so as to intermittently feed the fuel under pressure to the common rail 31. In the engine 1 of this embodiment having four cylinders 2, the high-pressure pump 32 feeds the fuel under pressure to the common rail 31, four times during one operation cycle of the engine 1 (corresponding to 720° crank angle). Here, a fuel tank and a fuel line (not shown), which are located upstream of the high-pressure pump 32 along the flow of the fuel, will be called "low-pressure stage of fuel system".

Figure 2:
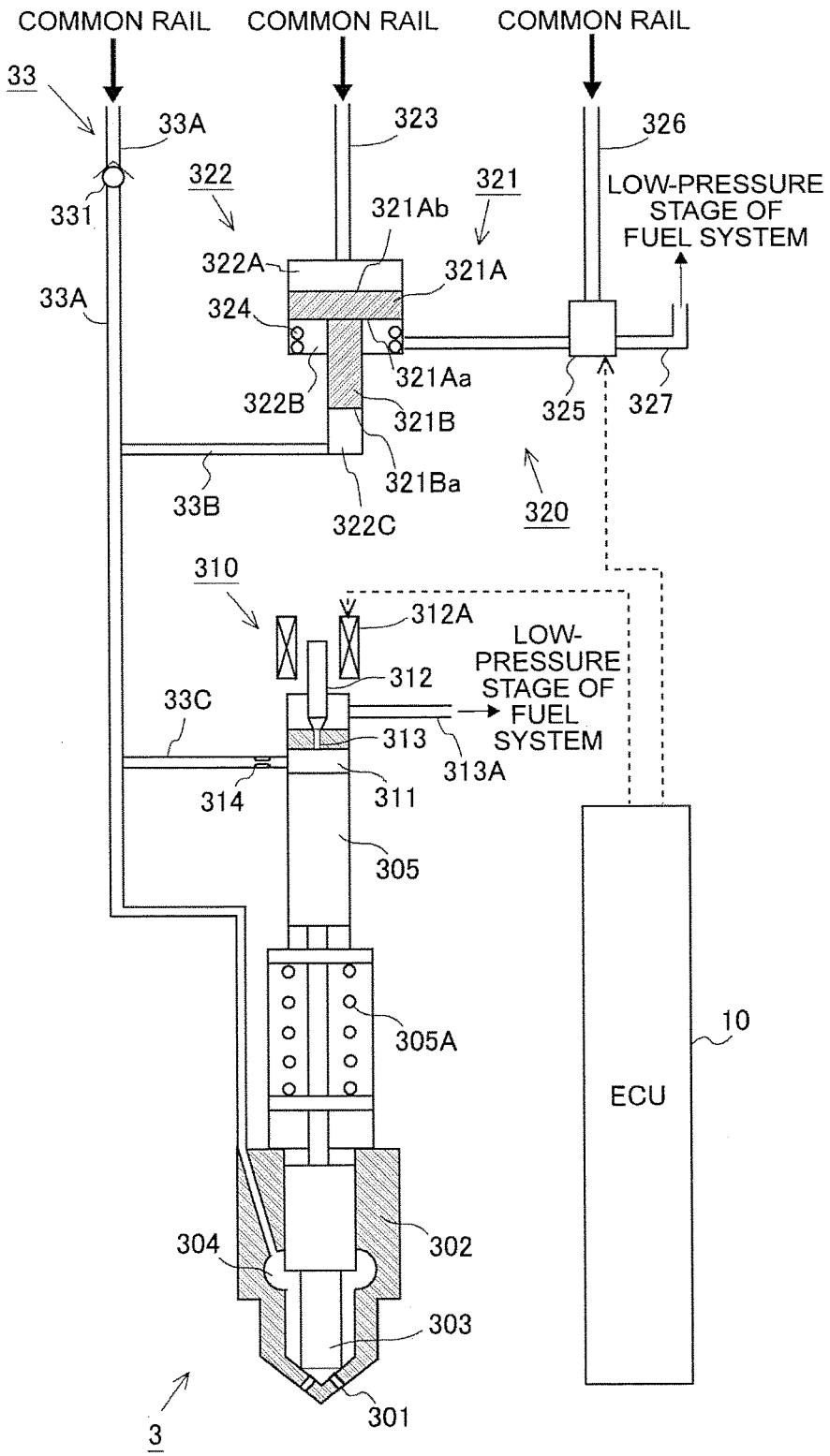
FIG. 2 is a view showing the general configuration of a fuel injection device including a fuel injection valve according to the embodiment of the disclosure.

Each fuel injection valve 3 is provided with an opening and closing mechanism 310. Here, the opening and closing mechanism 310 will be described, using FIG. 2 that shows the general configuration of a fuel injector including the fuel injection valve 3. As shown in FIG. 2, the fuel passage 33 consists of a first fuel passage 33A, a second fuel passage 33B, and a third fuel passage 33C. The first fuel passage 33A leads to the fuel injection valve 3 via a check valve 331. The first fuel passage 33A is provided with a pressure increasing device 320 that will be described later, and the pressure increasing device 320 is connected, via the second fuel passage 33B, to a part (which may be called "first fuel passage 33A on the fuel injection valve side") of the first fuel passage 33A which is closer to the fuel injection valve 3 than the check valve 331. The third fuel passage 33C connects the first fuel passage 33A on the fuel injection valve side with the opening and closing mechanism 310.

The fuel injection valve 3 includes a nozzle 302 that is formed with injection holes 301. A needle 303 that opens and closes the injection holes 301 is included in the fuel injection valve 3, and a fuel reservoir 304 is formed around the needle 303 in the nozzle 302. The fuel injection valve 3 also includes a command piston 305 and a first spring 305A. The command piston 305 pushes the needle 303 downward in FIG. 2 (toward the injection holes 301), under pressure of the fuel in a control chamber 311 that will be described later. The first spring 305A pushes the needle 303 in a valve-closing direction, independently of the command piston 305.

The control chamber 311 is formed adjacent to the command piston 305, upwardly of the piston 305 in FIG. 1 (in a direction in which the needle 303 moves away from the injection holes 301). The control chamber 311 is connected to the first fuel passage 33A on the fuel injection valve side, via the third fuel passage 33C provided with a second orifice 314. Also, an injection control valve 312 having a solenoid actuator 312A is provided in the control chamber 311. The ECU 10 that will be described later supplies a command signal to the solenoid actuator 312A, so that the injection control valve 312 is controlled by the ECU 10. When the ECU 10 operates the injection control valve 312, the fuel in the control chamber 311 flows into a drain pipe 313A via a first orifice 313, and the fuel flows back to the low-pressure stage of the fuel system. Namely, through operation of the injection control valve 312, the pressure of the fuel in the control chamber 311 is reduced. As a result, the pressure of the fuel in the control chamber 311 becomes lower than the pressure of the fuel in the first fuel passage 33A on the fuel injection valve side. The control chamber 311, injection control valve 312, solenoid actuator 312A, first orifice 313, drain pipe 313A, and the second orifice 314 constitute the opening and closing mechanism 310. In this embodiment, the injection control valve 312, solenoid actuator 312A, and the ECU 10 provide one example of a pressure reduction device according to the disclosure, which is operable to reduce the pressure of the fuel in the control chamber 311 to a level that is lower than the pressure of the fuel in the first fuel passage 33A connected to the control chamber 311.

The first fuel passage 33A is also connected to the fuel reservoir 304 of the nozzle 302. When the pressure increasing device 320 that will be described later is not in operation, the fuel from the common rail 31 flows through the first fuel passage 33A, and is supplied to the fuel reservoir 304. Since the fuel injection pressure is the pressure of the fuel in the fuel reservoir 304, and the fuel having the reference pressure is supplied from the common rail 31 to the fuel reservoir 304 at this time, the reference pressure becomes the fuel injection pressure. On the other hand, when the pressure increasing device 320 that will be described later is in operation, the pressure of the fuel increased by the pressure increasing device 320 becomes the fuel injection pressure.

The fuel pressure in the control chamber 311 is a fuel pressure applied to the needle 303 in such a direction as to close the injection holes 301, and the fuel pressure in the fuel reservoir 304 is a fuel pressure applied to the needle 303 in such a direction as to open the injection holes 301. The control chamber 311 and the fuel reservoir 304 communicate with each other via the second orifice 314 provided in the third fuel passage 33C. Therefore, when the injection control valve 312 is closed, the fuel pressure in the control chamber 311 is substantially equal to the fuel pressure in the first fuel passage 33A on the fuel injection valve side, third fuel passage 33C, and the fuel reservoir 304. In this condition, the needle 303 is pushed by the first spring 305A, and is pressed against a seat at the distal end of the nozzle 302, to close the injection holes 301.

On the other hand, when the solenoid actuator 312A is energized, and the injection control valve 312 is opened, the fuel in the control chamber 311 flows out into the drain pipe 313A through the first orifice 313, and the fuel pressure in the control chamber 311 is reduced. As a result, the fuel pressure in the control chamber 311 becomes lower than the fuel pressure in the first fuel passage 33A on the fuel injection valve side and the fuel pressure in the fuel reservoir 304, and a pressure difference (which may be called "first pressure difference") arises between the fuel pressure in the control chamber 311 and the fuel pressure in the fuel reservoir 304. Then, if the first pressure difference becomes equal to or larger than a pressure difference (which may be called "predetermined pressure difference") that is large enough to lift the needle 303, the needle 303 moves away from the injection holes 301, against the force with which the first spring 305A pushes the needle 303. Therefore, the injection holes 301 are opened, and the fuel in the fuel reservoir 304 is injected from the injection holes 301.

In the fuel injection valve 3 provided with the opening and closing mechanism 310 as described above, even if the solenoid actuator 312A is energized, and the injection control valve 312 is opened, no fuel is injected from the fuel injection valve 3 though the fuel pressure in the control chamber 311 is reduced, until the first pressure difference becomes equal to or larger than the predetermined pressure difference. This corresponds to a response delay (delay in valve opening of the fuel injection valve 3), or a length of time it takes from the time when a command signal is generated from the ECU 10 that will be described later to the solenoid actuator 312A, so as to inject fuel, to the time when the lift amount of the needle 303 starts increasing. Thus, in the fuel injection valve 3 according to this embodiment, it is possible to reduce the fuel pressure in the control chamber 311 without actually injecting the fuel, taking account of the fact that no fuel is injected from the fuel injection valve 3 though the fuel pressure in the control chamber 311 is reduced during the period of response delay as described above.

If the fuel pressure in the control chamber 311 is reduced in this manner, the fuel pressures in the third fuel passage 33C and the first fuel passage 33A are also subsequently reduced (the fuel pressure in the third fuel passage 33C is initially reduced, and that of the first fuel passage 33A is then reduced). As a result, after reduction of the fuel pressure in the first fuel passage 33A, the reference pressure as the fuel pressure in the common rail 31 is reduced.

The first fuel passage 33A is also provided with the pressure increasing device 320. Here, the pressure increasing device 320 will be described below, using FIG. 2 as described above. The pressure increasing device 320 includes a pressure increasing piston 321 and an accommodation chamber 322, and the pressure increasing piston 321 is slidably held in the accommodation chamber 322. The pressure increasing piston 321 has a large-diameter piston portion 321A and a small-diameter piston portion 321B. Further, the large-diameter piston portion 321A and the small-diameter piston portion 321B slide as a unit in the accommodation chamber 322, and are formed generally in the shape of a shaft that extends along the sliding direction. The large-diameter piston portion 321A has an end portion (which will be called "first end portion") 321Aa facing the small-diameter piston portion 321B, and an end portion (which will be called "second end portion") 321Ab opposite to the first end portion 321Aa. The small-diameter piston portion 321B cooperates with the large-diameter piston portion 321A to provide an integral structure, with one end portion of the small-diameter piston portion 321B being in abutting contact with the first end portion 321Aa, and the other end portion (which will be called "third end portion") 321Ba is formed generally in parallel with the second end portion 321Ab. In the pressure increasing piston 321 thus formed, the area (which will be called "second end portion area") of the second end portion 321Ab and the area (which will be called "third end portion area") of the third end portion 321Ba have a fixed ratio as indicated by the following equation (1):

$Ar=A2/A3$ where Ar is the area ratio, A2 is the area of the second end portion, and A3 is the area of the third end portion. Since the diameter of the large-diameter piston portion 321A is larger than that of the small-diameter piston portion 321B, and the area A2 of the second end portion is larger than the area A3 of the third end portion, the area ratio indicated by the above equation (1) is a fixed value larger than 1. Also, the area A2 of the second end portion is substantially equal to the sum of the area of the first end portion 321Aa and the area A3 of the third end portion.

The pressure increasing piston 321 is disposed in the accommodation chamber 322, such that a pressure chamber 322A, a pressure increase control chamber 322B, and a pressure increasing chamber 322C are formed in the accommodation chamber 322. The pressure chamber 322A is formed by the accommodation chamber 322 and the second end portion 321Ab, and the pressure increase control chamber 322B is formed by the accommodation chamber 322, first end portion 321Aa, and the small-diameter piston portion 321B, while the pressure increasing chamber 322C is formed by the accommodation chamber 322 and the third end portion 321Ba. The pressure chamber 322A communicates with the common rail 31 via a pressure chamber fuel path 323. The pressure increasing chamber 322C communicates with the second fuel passage 33B. The second fuel passage 33B connects the pressure increasing chamber 322C with the first fuel passage 33A on the fuel injection valve side.

The pressure increasing device 320 includes a pressure increase control valve 325. The pressure increase control valve 325 communicates with the common rail 31 via a pressure increase control valve fuel path 326. The pressure increase control valve 325 is also connected to the pressure increase control chamber 322B. The pressure increase control valve 325 is a solenoid-driven switching valve, and selectively connects the pressure increase control chamber 322B with the pressure increase control valve fuel path 326 or a return passage 327. The pressure increase control valve 325 is controlled by the ECU 10 that will be described later. The return passage 327 allows the fuel to flow out from the pressure increase control chamber 322B, so that the fuel flows back to the low-pressure stage of the fuel system.

When the pressure increasing device 320 is not in operation, energization of the solenoid of the pressure increase control valve 325 is stopped, and the reference pressure is applied to the pressure increase control chamber 322B, since the pressure increase control chamber 322B is connected to the pressure increase control valve fuel path 326 via the pressure increase control valve 325. The reference pressure is also applied to the pressure chamber 322A of the pressure increasing device 320 via the pressure chamber fuel path 323. Further, the reference pressure is applied to the pressure increasing chamber 322C of the pressure increasing device 320, as described later. Therefore, the force produced by the fuel pressure applied to the second end portion 321Ab is substantially equal to the force produced by the fuel pressure applied to the first end portion 321Aa and the third end portion 321Ba.

In this condition, the pressure increasing piston 321 is pushed by a second spring 324 that biases the large-diameter piston portion 321A toward the pressure chamber 322A, to be moved upward in FIG. 2, and the fuel flows from the common rail 31 into the pressure increasing chamber 322C, through the first fuel passage 33A, check valve 331, and the second fuel passage 33B. Therefore, the fuel pressures in the pressure increasing chamber 322C, second fuel passage 33B, first fuel passage 33A, and the fuel reservoir 304 are equal to the reference pressure. Namely, when the pressure increasing device 320 is not in operation, the reference pressure provides the fuel injection pressure.

On the other hand, if the solenoid of the pressure increase control valve 325 is energized, the pressure increase control chamber 322B is connected to the return passage 327 via the pressure increase control valve 325. As a result, the fuel in the pressure increase control chamber 322B flows into the return passage 327 via the pressure increase control valve 325, and the pressure in the pressure increase control chamber 322B is reduced. Therefore, the pressure increasing piston 321 is pushed under the fuel pressure (i.e., reference pressure) in the pressure chamber 322A applied to the second end portion 321Ab, and the fuel in the pressure increasing chamber 322C is pressurized by the small-diameter piston portion 321B. As a result, the fuel pressure in the pressure increasing chamber 322C is increased to a value obtained by multiplying the reference pressure in the pressure chamber 322A, by the area ratio Ar indicated by the above equation (1).

Namely, when the pressure increasing device 320 is in operation, the fuel pressures in the pressure increasing chamber 322C, second fuel passage 33B, first fuel passage 33A on the fuel injection valve side, and the fuel reservoir 304 are increased to the value obtained by multiplying the reference pressure by the area ratio Ar indicated by the above equation (1). The area ratio Ar indicated by the above equation (1) will be called "pressure increase ratio". The pressure increase ratio is a predetermined value that is determined by the shape of the pressure increasing piston 321. Accordingly, when the pressure increasing device 320 is in operation, the fuel pressure in the fuel reservoir 304 becomes equal to a pressure (which may be called "pressure increase ratio multiplied pressure) obtained by multiplying the reference pressure by the pressure increase ratio, and the pressure increase ratio multiplied pressure provides the fuel injection pressure.

The internal combustion engine 1 is equipped with an electronic control unit (ECU) 10. The ECU 10 controls operating conditions of the engine 1. Various sensors, such as an accelerator position sensor 6 and a crank position sensor 7, as well as the above-mentioned pressure sensor 34 and the air flow meter 40, are electrically connected to the ECU 10. The accelerator position sensor 6 outputs an electric signal correlated with the operation amount (pedal stroke) of the accelerator pedal. The crank position sensor 7 outputs an electric signal correlated with the rotational position of an engine output shaft (crankshaft) of the engine 1. The ECU 10 receives the output signals of these sensors. The ECU 10 derives the engine load of the engine 1, based on the output signal of the accelerator position sensor 6. The ECU 10 also derives the engine rotational speed of the engine 1, based on the output signal of the crank position sensor 7.

Also, various devices, such as the high-pressure pump 32, throttle valve 41, solenoid actuator 312A, and the pressure increase control valve 325, are electrically connected to the ECU 10. These devices are controlled by the ECU 10.

Figure 3:
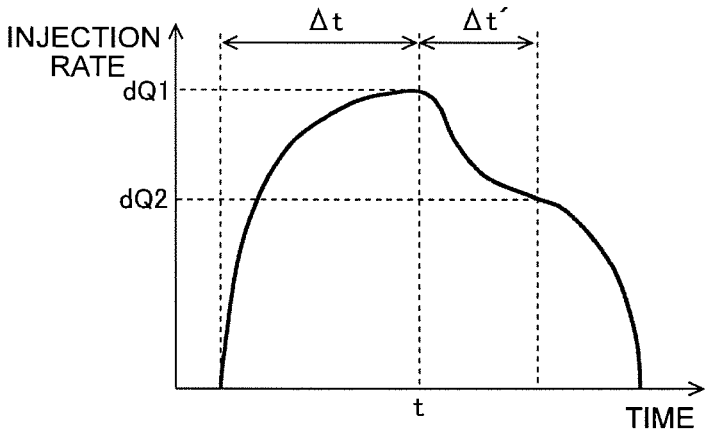
FIG. 3 is a view showing the concept of initial high injection rate and later low injection rate according to the embodiment of the disclosure.

In the meantime, if the fuel injection rate in the initial stage of fuel injection is low, the amount of smoke generated in the cylinder 2 may be increased when the fuel is burned in the internal combustion engine 1. On the other hand, if the fuel injection rate is high in the later stage of fuel injection, fuel spray may be excessively diffused, and a cooling loss may be increased due to combustion flame that spreads to the vicinity of a wall of the cylinder 2. The inventor of this disclosure found that this problem can be solved by increasing the fuel injection rate in the initial stage of fuel injection, and reducing the fuel injection rate in the later stage of fuel injection. This pattern of fuel injection rate will be called "initial high injection rate and later low injection rate". The concept of the "initial high injection rate and later low injection rate" is illustrated in FIG. 3. As shown in FIG. 3, the fuel injection ratio is high in the initial stage of fuel injection, but is significantly reduced from dQ1 to dQ2, in a period Δt' that follows time t at which a period Δt has passed from the start of fuel injection. As a result, the fuel injection rate is reduced in the later stage of fuel injection. According to the known technology, the fuel injection having the above pattern of initial high injection rate and later low injection rate could not be realized.

Thus, the ECU 10 according to this embodiment opens the injection control valve 312 such that the first pressure difference is equal to or larger than the predetermined pressure difference, so as to perform fuel injection from the fuel injection valve 3. During fuel injection by the fuel injection valve 3 (which may be called "first injection valve") that is currently injecting fuel, out of the fuel injection valves 3 provided for the respective cylinders 2, and after a lapse of a predetermined period from the start of fuel injection by the first injection valve, the injection control valve 312 is opened such that the first pressure difference is smaller than the predetermined pressure difference, in a fuel injection valve 3 (which may be called "second injection valve") that is different from the first injection valve, out of the fuel injection valves 3 provided for the respective cylinders 2. The operation of the injection control valve 312 in the second injection valve will be called "blank operation". When the blank operation is performed, the reference pressure as the fuel pressure in the common rail 31 is reduced, during fuel injection by the first injection valve. In this embodiment, the ECU 10, which performs fuel injection in the manner as described above, functions as one example of opening and closing control device according to the disclosure. Also, the ECU 10, which performs the blank operation, functions as one example of reference pressure control device according to this disclosure.

Figure 4:
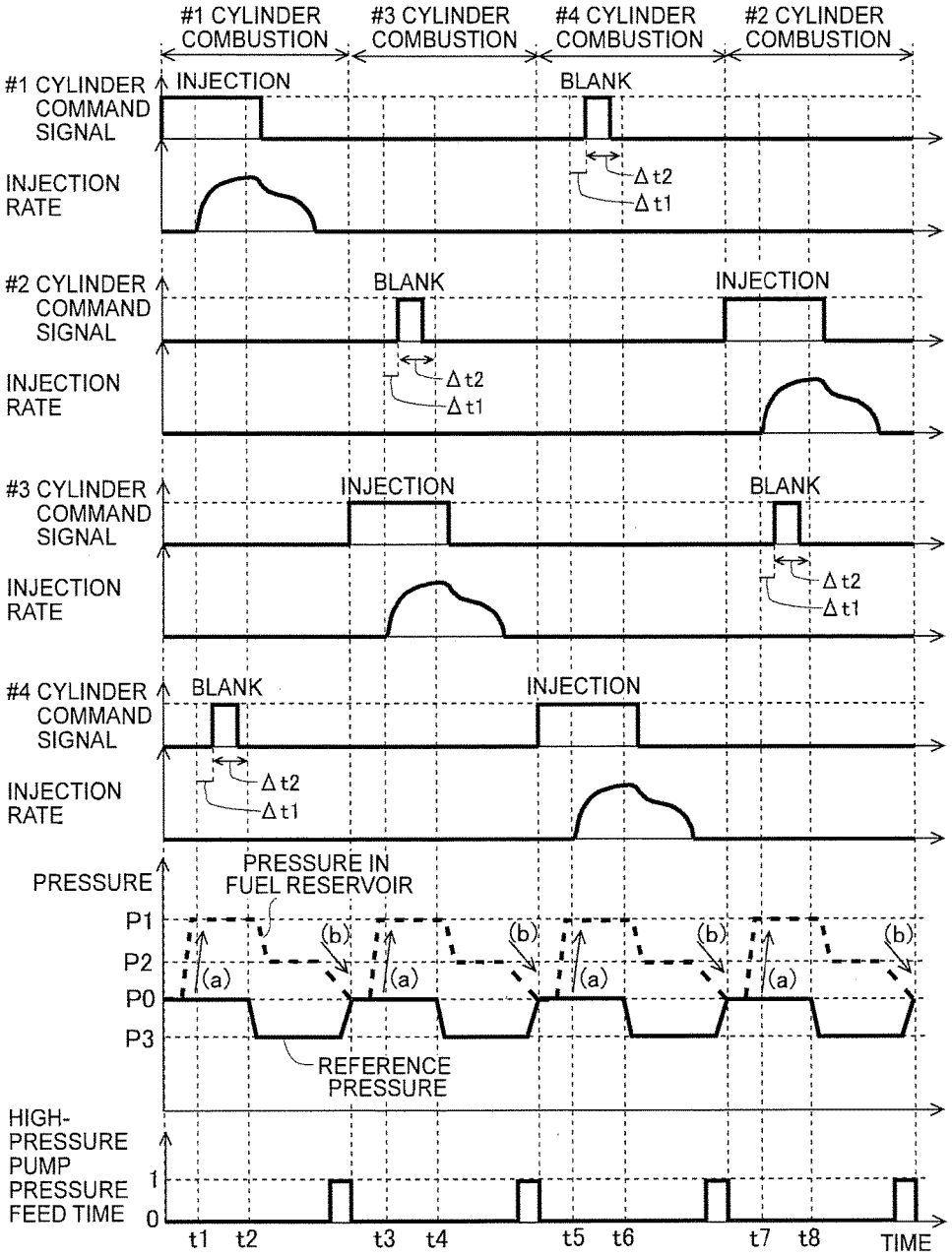
FIG. 4 is a view showing a time chart of the case where blank operation is performed according to a first embodiment of the disclosure.

A first embodiment will be described. FIG. 4 is a time chart of the first embodiment. In FIG. 4, changes of the command signal transmitted from the ECU 10 to the solenoid actuator 312A and the rate of fuel injection from the fuel injection valve 3 in each cylinder 2 with time are indicated in the order of #1 cylinder to #4 cylinder. Further, changes of the fuel pressure in the fuel reservoir 304 of the first injection valve and the reference pressure with time, and the timing of fuel pressure feeding from the high-pressure pump 32 are also indicated. FIG. 4 shows changes of these parameters with time in one operation cycle (720° crank angle) of the engine 1, and the fuel is burned in the cylinder 2, in the order of #1 cylinder, #3 cylinder, #4 cylinder, and #2 cylinder, in the operation cycle. During fuel injection by the first injection valve, the fuel pressure in the fuel reservoir 304 is the fuel injection pressure.

In the control process shown in FIG. 4, initially, a command signal of fuel injection is transmitted to the solenoid actuator 312A, on the combustion stroke of #1 cylinder. Then, fuel injection from the fuel injection valve 3 provided in #1 cylinder (the fuel injection valve 3 provided in #1 cylinder is one example of the first injection valve at this time) is started, at time t1 after a lapse of a delay period as a period it takes until the first pressure difference becomes equal to or larger than the predetermined pressure difference. Before the start of the fuel injection, the fuel pressure in the fuel reservoir 304 in the first injection valve is increased from pressure P0 to pressure P1, by the pressure increasing device 320 provided in the first fuel passage 33A that leads to the first injection valve, and the fuel injection pressure at the start of fuel injection is equal to pressure P1. Namely, the fuel pressure in the fuel reservoir 304, which is equal to pressure P0 as the reference pressure when the pressure increasing device 320 is not in operation, is increased to the pressure increase ratio multiplied pressure obtained by multiplying the pressure P0 by the pressure increase ratio, through operation of the pressure increasing device 320. As a result, the fuel injection pressure at the start of fuel injection becomes equal to pressure P1. Thus, the fuel injection pressure in the first injection valve becomes equal to pressure P1 as the pressure increase ratio multiplied pressure, so that the fuel injection rate (the fuel injection rate in the initial stage of fuel injection) of the fuel injection by the first injection valve becomes high, until time t2 as described later is reached.

Then, during fuel injection by the first injection valve, and after a lapse of a predetermined period Δt1 from time t1 as the start time of fuel injection by the first injection valve, a command signal for blank operation is transmitted to the solenoid actuator 312A in the fuel injection valve 3 provided in #4 cylinder that is different from the first injection valve (namely, at this time, the fuel injection valve 3 provided in #4 cylinder is one example of the second injection valve). Namely, according to this disclosure, this is one example where the reference pressure control device operates a pressure reducing device corresponding to the second injection valve such that the first pressure difference is smaller than the predetermined pressure difference, in the second injection valve, during fuel injection by the first injection valve, and after the lapse of the predetermined period from the start of the fuel injection by the first injection valve. Here, the predetermined period Δt1 is determined in advance based on experiments, or the like, and stored in the ROM of the ECU 10, so that the fuel injection rate can be reduced at a desired point in time in the later stage of fuel injection. As described above, the blank operation is performed by opening the injection control valve 312 such that the first pressure difference is smaller than the predetermined pressure difference, and reducing the fuel pressure in the control chamber 311 so as to reduce the reference pressure, utilizing the fact that no fuel is injected from the fuel injection valve 3 though the fuel pressure in the control chamber 311 is reduced, during the response delay period or until the lift amount of the needle 303 starts increasing. Accordingly, the command signal of the blank operation is a signal having a shorter duration than that it takes until the needle 303 opens the injection holes 301. If the blank operation is performed in the second injection valve, the reference pressure starts being reduced at time t2*m* or after a lapse of a given delay time Δt2 from the start of the operation.

Then, as the reference pressure is reduced from pressure P0 to pressure P3 after time t2, the fuel pressure in the fuel reservoir 304 of the first injection valve (the fuel injection valve 3 provided in #1 cylinder), which leads to the common rail 31, is reduced from pressure P1 to pressure P2. At this time, while the fuel pressure in the fuel reservoir 304 of the first injection valve is increased by the pressure increasing device 320, the reference pressure is reduced from pressure P0 to pressure P3, and therefore, the fuel pressure in the fuel reservoir 304, as the pressure increase ratio multiplied pressure, is also reduced from pressure P1 to pressure P2. Here, the fuel injection pressure and the fuel injection rate have a relationship that the fuel injection rate is reduced as the fuel injection pressure is reduced when the injection holes 301 have the same diameter. Therefore, as the fuel pressure in the fuel reservoir 304 of the first injection valve, namely, the pressure of the fuel injected from the first injection valve, is reduced from pressure P1 to pressure P2, the fuel injection rate during fuel injection by the first injection valve is reduced to a fuel injection rate corresponding to the fuel injection pressure P2. Namely, the fuel injection rate that has been increased during a period (the initial stage of fuel injection) down to time t2 is reduced after time t2 (in the later stage of fuel injection).

Then, when the fuel injection in the first injection valve is completed, increase of the fuel pressure in the fuel reservoir 304 of the first injection valve by the pressure increasing device 320 is finished. Meanwhile, the high-pressure pump 32 feeds the fuel under pressure to the common rail 31, four times during one operation cycle (720° crank angle) of the engine 1 as described above, and the pressure feeding time is set at a point after completion of the fuel injection by the first injection valve, as shown in FIG. 4. Accordingly, after completion of the fuel injection by the first injection valve, the high-pressure pump 32 feeds the fuel under pressure to the common rail 31. In the graph of FIG. 4 indicating the pressure feeding time of the high-pressure pump 32, 0 indicates a condition where no fuel is fed under pressure, and 1 indicates a condition where fuel is fed under pressure. It follows that the reference pressure recovers from the pressure P3 to the original pressure P0, after completion of the fuel injection by the first injection valve, and the fuel pressure in the fuel reservoir 304 of the first injection valve, which is reduced from pressure P2 due to the end of pressure increasing, becomes equal to pressure P0 as the reference pressure at this time.

Then, in the control process shown in FIG. 4, on the combustion stroke of #3 cylinder, fuel injection from the fuel injection valve 3 provided in #3 cylinder (namely, the fuel injection valve 3 provided in #3 cylinder at this time is one example of the first injection valve) is started at time t3, in the same manner as that on the combustion stroke of #1 cylinder. Then, during fuel injection by the first injection valve, and after a lapse of the predetermined period Δt1 from time t3 as the start time of fuel injection by the first injection valve, a command signal for blank operation is transmitted to the solenoid actuator 312A of the fuel injection valve 3 provided in #2 cylinder corresponding to the second injection valve at this time, and blank operation is performed in the second injection valve. The reference pressure starts being reduced at time t4 after a lapse of the given delay time Δt2 from the start of blank operation, and the fuel injection pressure from the first injection valve, which has been increased to pressure P1 by the pressure increasing device 320, is reduced from pressure P1 to pressure P2. As a result, the fuel injection rate during fuel injection by the first injection valve is reduced to the fuel injection rate corresponding to the fuel injection pressure P2.

The control operation similar to that as described above is also performed, on the combustion strokes of #4 cylinder and #2 cylinder after (following) the combustion stroke of #3 cylinder. Namely, on the combustion stroke of #4 cylinder, the blank operation is performed in the fuel injection valve 3 provided in #1 cylinder, so that the fuel injection rate during fuel injection by the first injection valve (here, the fuel injection valve 3 provided in #4 cylinder) is reduced to the fuel injection rate corresponding to the fuel injection pressure P2. On the combustion stroke of #2 cylinder, the blank operation is performed in the fuel injection valve 3 provided in #3 cylinder, so that the fuel injection rate during fuel injection by the first inductor (here, the fuel injection valve 3 provided in #2 cylinder) is reduced to the fuel injection rate corresponding to the fuel injection pressure P2.

In the control process shown in FIG. 4, the fuel injection valve 3 provided in the cylinder 2 (which may be called "reverse cylinder") that is placed in the combustion stroke 360° crank angle after the combustion stroke of the cylinder 2 in which the first injection valve is provided provides the second injection valve as a rule. While the blank operation is carried out only in the fuel injection valve 3 provided in the reverse cylinder, in the control process shown in FIG. 4, blank operation may be carried out in two or more second injection valves.

In the control system for the internal combustion engine 1 according to the first embodiment, the reference pressure during fuel injection by the first injection valve is reduced as described above, so that the fuel injection having the pattern of the initial high injection rate and the later low injection rate is realized. Consequently, smoke is less likely or unlikely to be generated in the cylinder 2 in the initial stage of fuel injection, and a cooling loss can be minimized in the later stage of fuel injection.

Figure 5:
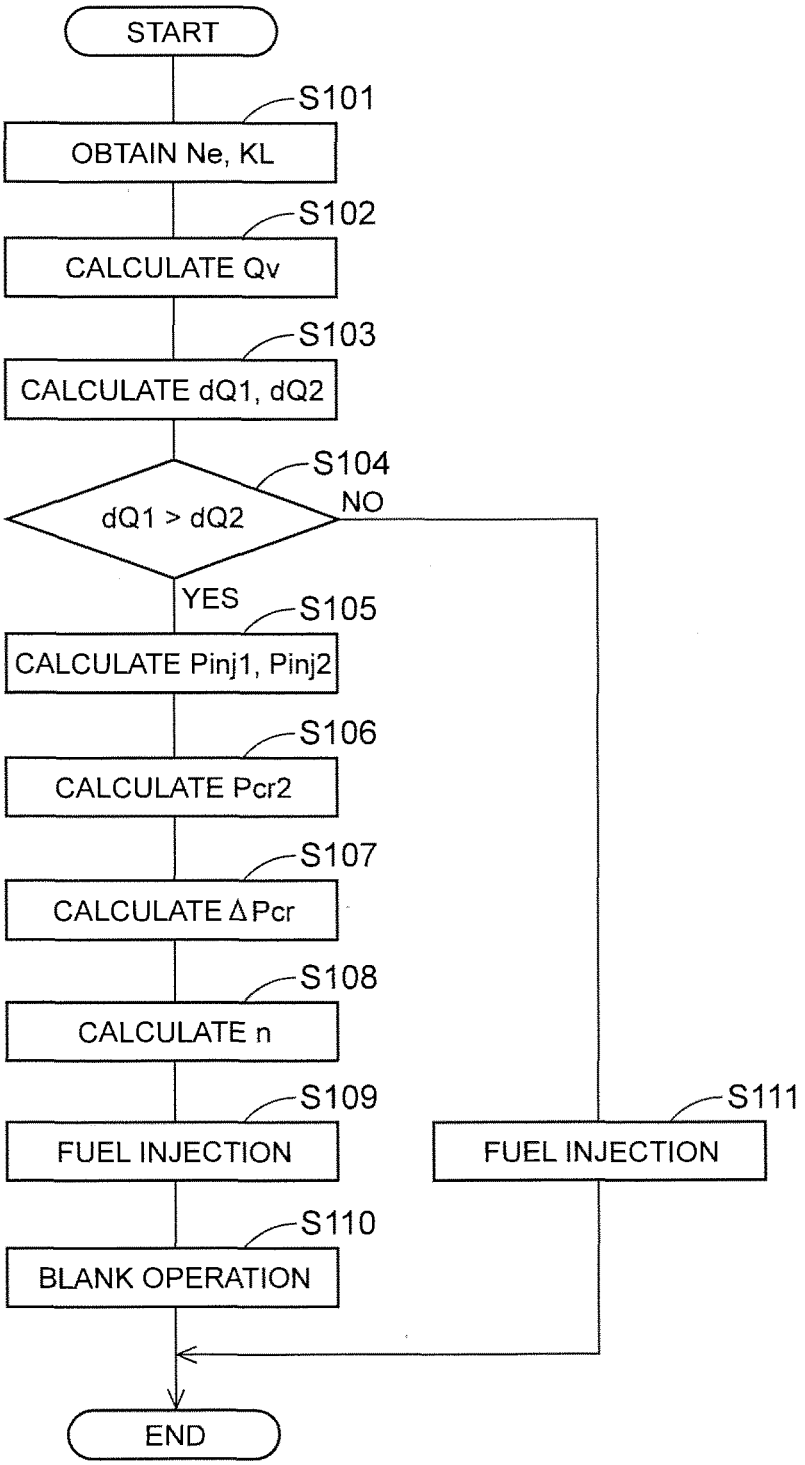
FIG. 5 is a flowchart illustrating a control flow executed by a control system for the internal combustion engine according to the first embodiment of the disclosure.

Here, a control flow executed by the control system for the internal combustion engine 1 according to the first embodiment will be described based on FIG. 5. FIG. 5 is a flowchart illustrating the control flow, in the control system for the engine 1 according to the first embodiment. In the first embodiment, the ECU 10 repeatedly executes the control flow at given computation intervals, during operation of the engine 1.

In the control flow of FIG. 5, initially in step S101, the ECU 10 obtains the engine speed Ne of the engine 1 based on the output signal of the crank position sensor 7, and obtains the engine load KL of the engine 1 based on the output signal of the accelerator position sensor 6. Then, in step S102, the fuel injection amount Qv is calculated, based on the engine load KL obtained in step S101.

After execution of step S102, the initial fuel injection rate dQ1 and the later fuel injection rate dQ2 are calculated, based on the engine speed Ne obtained in step S101 and the fuel injection amount Qv calculated in step S102. The relationships between the initial fuel injection rate dQ1, later fuel injection rate dQ2, and the period (period Δt shown in FIG. 3 above) from the start of fuel injection to the time when the fuel injection rate starts being reduced to the later fuel injection rate dQ2, and the engine speed Ne and the fuel injection amount Qv, are stored in advance in the form of a map or a function. In step S103, the initial fuel injection rate dQ1 and the later fuel injection rate dQ2 are calculated using this map or function.

Then, it is determined in step S104 whether the initial fuel injection rate dQ1 calculated in step S103 is larger than the later fuel injection rate dQ2. The initial fuel injection rate dQ1 is larger than the later fuel injection rate dQ2, when promotion of evaporation of fuel spray in the initial stage of fuel injection, and suppression or prevention of excessive diffusion of fuel spray in the later stage of fuel injection, are both requested. Then, in this case, the ECU 10 controls fuel injection, so that the fuel injection rate becomes high in the initial stage of fuel injection, and is reduced from the initial fuel injection rate dQ1 to the later fuel injection rate dQ2 in the later stage, as shown in FIG. 3 above. If an affirmative decision (YES) is obtained in step S104, the ECU 10 proceeds to step S105. If a negative decision (NO) is obtained in step S104, the ECU 10 proceeds to step S111.

If an affirmative decision (YES) is obtained in step S104, the initial fuel injection pressure Pinj1 and the later fuel injection pressure Pinj2 are calculated in step S105. In step S105, the initial fuel injection pressure Pinj1 is calculated by multiplying the reference pressure Pcr before pressure reduction by the pressure increase ratio (namely, the area ratio Ar as described above). Also, the later fuel injection pressure Pinj2, which is a fuel injection pressure required to inject fuel at the later fuel injection rate dQ2, is calculated according to the following equation (2).

$$Pinj2=Pinj1\times(dQ2/dQ1)^2 \quad (2)$$

The ECU 10 calculates the later fuel injection pressure Pinj2, using the above parameters. The reference pressure Pcr before pressure reduction is detected by the pressure sensor 34. The initial fuel injection pressure Pinj1 and the later fuel injection pressure Pinj2 correspond to pressure P1 and pressure P2 shown in FIG. 4 as described above.

Then, in step S106, the reference pressure Pcr2 after pressure reduction, as the reference pressure established when the fuel injection is performed at the later fuel injection pressure Pinj2, is calculated. In step S106, the reference pressure Pcr2 after pressure reduction is calculated according to the following equation (3).

$$Pcr2=Pinj2/Ar \quad (3)$$

The ECU 10 calculates the reference pressure Pcr2 after pressure reduction, using the later fuel injection pressure Pinj2 calculated in step S105 and the pressure increase ratio (area ratio) Ar.

Then, in step S107, a pressure difference ΔPcr is calculated. The pressure difference ΔPcr is a difference in pressure between the pre-reduction reference pressure Pcr and the post-reduction reference pressure Pcr2, and is calculated according to the following equation (4)

$$\Delta Pcr=Pcr-Pcr2 \quad (4)$$

The ECU 10 calculates the pressure difference ΔPcr, using the pre-reduction reference pressure Pcr detected by the pressure sensor 34 and the post-reduction reference pressure Pcr2 calculated in step S106. The pre-reduction reference pressure Pcr and the post-reduction reference pressure Pcr2 correspond to pressure P0 and pressure P3 shown in FIG. 4 above.

Then, in step S108, the number "n" of operations as the number of the second injection valves in which the blank operation is performed is calculated. In step S108, the number "n" of operations is calculated based on the pressure difference ΔPcr calculated in step S107. The amount of reduction of the reference pressure per second injection valve through the blank operation can be determined in advance by experiment, or the like. Then, if the pressure difference ΔPcr calculated in step S107 is larger than the amount of reduction of the reference pressure per second injection valve, the number "n" of operations needs to be an integer equal to or larger than 2. In the ROM of the ECU 10, the relationship between the number "n" of operations and the pressure difference ΔPcr is stored in advance in the form of a map or a function, and the number "n" of operations is calculated using the map or function.

Then, in step S109, the fuel is injected from the fuel injection valve 3. In the initial stage of the fuel injection, namely, until the blank operation is performed, the fuel injection pressure is made equal to the initial fuel injection pressure Pinj1. When the lift amount of the needle 303 starts increasing as the fuel injection of step S109 starts, the rate of fuel injection from the fuel injection valve 3 (i.e., the first injection valve) increases, and becomes equal to the initial fuel injection rate dQ1 after a lapse of a certain time.

Then, in step S110, the blank operation is performed. In step S110, the blank operation is performed in the second injection valve(s) corresponding to the number "n" of operations calculated in step S108. Also, the blank operation is performed during fuel injection by the first injection valve, after a lapse of a predetermined period from the start of fuel injection by the first injection valve. As described above, the predetermined period is determined in advance based on experiment, or the like, and stored in the ROM of the ECU 10. When the number "n" of operations is one, for example, the blank operation is performed in the second injection valve provided in the reverse cylinder of the cylinder 2 in which the first injection valve is provided, as described above. When the number "n" of operations is two or more, for example, the blank operation is performed in the second injection valve provided in the reverse cylinder of the cylinder 2 in which the first injection valve is provided, and another second injection valve or fuel injection valve 3 that is different from the first injection valve, and is provided in a given cylinder 2 that is different from the reverse cylinder. Then, if the blank operation is performed in step S110, the reference pressure is reduced from the pre-reduction reference pressure Pcr to the post-reduction reference pressure Pcr2, after a lapse of a given delay time (for example, after a lapse of the given delay time Δt2 shown in FIG. 4). With the reference pressure thus reduced, the fuel injection pressure is reduced from the initial fuel injection pressure Pinj1 to the later fuel injection pressure Pinj2, and the fuel injection rate is reduced from the initial fuel injection rate dQ1 to the later fuel injection rate dQ2. Then, after execution of step S110, execution of the control flow of FIG. 5 ends.

If a negative decision (NO) is obtained in step S104, as is the case with the related art, the fuel is injected from the fuel injection valve 3 in step S111 so as to realize the initial fuel injection rate dQ1 and the later fuel injection rate dQ2. Since this case belongs to the related art, details will not be provided. After execution of step S111, execution of the control flow of FIG. 5 ends.

As in the control flow as described above, the blank operation is performed, during fuel injection from the first injection valve, after the lapse of the predetermined period from the start of fuel injection by the first injection valve, so that generation of smoke in the cylinder 2 in the initial stage of fuel injection is suppressed, and the cooling loss in the later stage of fuel injection is minimized.

Next, a first modified example of the first embodiment will be described. The first embodiment is an example in which only main injection from the fuel injection valve 3 is performed on one combustion stroke. In the modified example, on the other hand, main injection and after injection are performed by the fuel injection valve 3. In the modified example, substantially the same configuration and substantially the same control operation as those of the first embodiment will not be described in detail.

Figure 6:
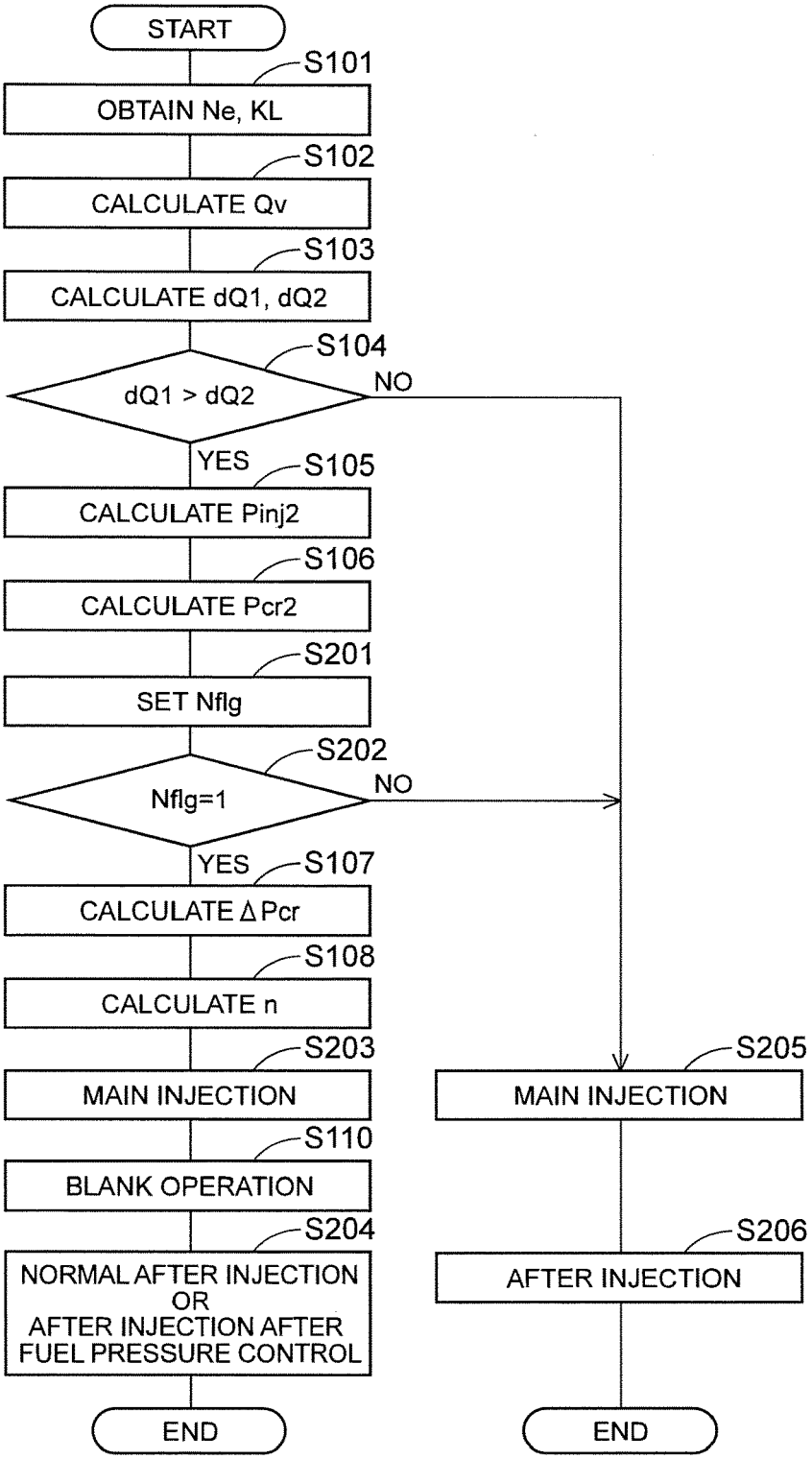
FIG. 6 is a flowchart illustrating a control flow executed by a control system for the internal combustion engine according to a first modified example of the first embodiment of the disclosure.

A control flow executed by the control system for the engine 1 according to the modified example will be described based on FIG. 6. FIG. 6 is a flowchart illustrating the control flow, in the control system for the engine 1 according to the modified example. In the modified example, the ECU 10 repeatedly executes the control flow of FIG. 6 at given computation intervals, during operation of the engine 1.

In the control flow shown in FIG. 6, after execution of step S106, a blank operation execution determination flag Nflg is set in step S201. The blank operation execution determination flag Nflg is a flag that is set to 1 when the blank operation can be executed, and is set to 0 when the blank operation cannot be executed. A method of setting the flag will be described later. The ECU 10 proceeds to step S202 after executing step S201.

Then, it is determined in step S202 whether the blank operation execution determination flag Nflg set in step S201 is 1. If an affirmative decision (YES) is obtained in step S202, the ECU 10 proceeds to step S107. If a negative decision (NO) is obtained in step S202, the ECU 10 proceeds to step S205.

In the control flow shown in FIG. 6, after execution of step S108, main injection from the fuel injection valve 3 is carried out. At this time, in the initial stage of the main injection, namely, until the blank operation is performed, the fuel injection pressure is set to the initial fuel injection pressure Pinj1. When the lift amount of the needle 303 starts increasing as the main injection of step S203 starts, the rate of fuel injection from the fuel injection valve 3 (i.e., the first injection valve) increases, and becomes equal to the initial fuel injection rate dQ1 after a lapse of a certain time. The ECU 10 proceeds to step S110 after executing step S203, and performs blank operation in the second injection valve.

Then, in the control flow shown in FIG. 6, after execution of step S110, after injection from the fuel injection valve 3 is performed in step S204. In step S204, normal after injection, or after injection after fuel pressure control is performed according to a fuel pressure control determination flag Nflg' that will be described later. More specifically, the normal after injection is performed when the fuel pressure control determination flag Nflg' that will be described later is 0, and the after injection after fuel pressure control is performed when the fuel pressure control determination flag Nflg' that will be described later is 1 or 2. Then, after execution of step S204, execution of the control flow ends. Here, the normal after injection is after injection through which the fuel injection pressure becomes equal to the post-reduction reference pressure Pcr2. When the normal after injection is performed, increase of the fuel pressure in the fuel reservoir 304 of the first injection valve by the pressure increasing device 320 is finished after completion of the main injection, and the fuel is injected at the post-reduction reference pressure Pcr2 as the reference pressure at this time. The after injection after fuel pressure control is after injection through which the fuel injection pressure becomes lower than the post-reduction reference pressure Pcr2, or becomes higher than the post-reduction reference pressure Pcr2. The fuel injection pressure becomes lower than the post-reduction reference pressure Pcr2 when the fuel pressure control determination flag Nflg' is 1, and becomes higher than the post-reduction reference pressure Pcr2 when the fuel pressure control determination flag Nflg' is 2.

When the fuel pressure control determination flag Nflg' is 1, increase of the fuel pressure in the fuel reservoir 304 of the first injection valve by the pressure increasing device 320 is finished after completion of the main injection, and the reference pressure as the fuel pressure in the common rail 31 is further reduced. As a result, the reference pressure becomes lower than the post-reduction reference pressure Pcr2, and the fuel is injected at this pressure. Thus, the reference pressure can be further reduced, by performing blank operation again.

When the fuel pressure control determination flag Nflg' is 2, increase of the fuel pressure in the fuel reservoir 304 of the first injection valve by the pressure increasing device 320 is finished after completion of the main injection, and the fuel pressure is subsequently increased again by the pressure increasing device 320. As a result, the fuel is injected at the pressure increase ratio multiplied pressure that is higher than the post-reduction reference pressure Pcr2. The reference pressure may be reduced through blank operation, before the fuel pressure is increased again by the pressure increasing device 320.

In the control flow shown in FIG. 6, when a negative decision (NO) is obtained in step S104, or a negative decision (NO) is obtained in step S202, as is the case with the related art, main injection from the fuel injection valve 3 is carried out in step S205 so as to realize the initial fuel injection rate dQ1 and the later fuel injection rate dQ2. Since this case belongs to the related art, details will not be provided. After execution of step S205, after injection from the fuel injection valve 3 is carried out in step S206. At this time, increase of the fuel pressure in the fuel reservoir 304 of the first injection valve by the pressure increasing device 320 is finished after completion of the main injection, and the fuel injection pressure is equal to the post-reduction reference pressure Pcr in step S206. After execution of step S206, execution of the control flow of FIG. 6 ends.

Figure 7:
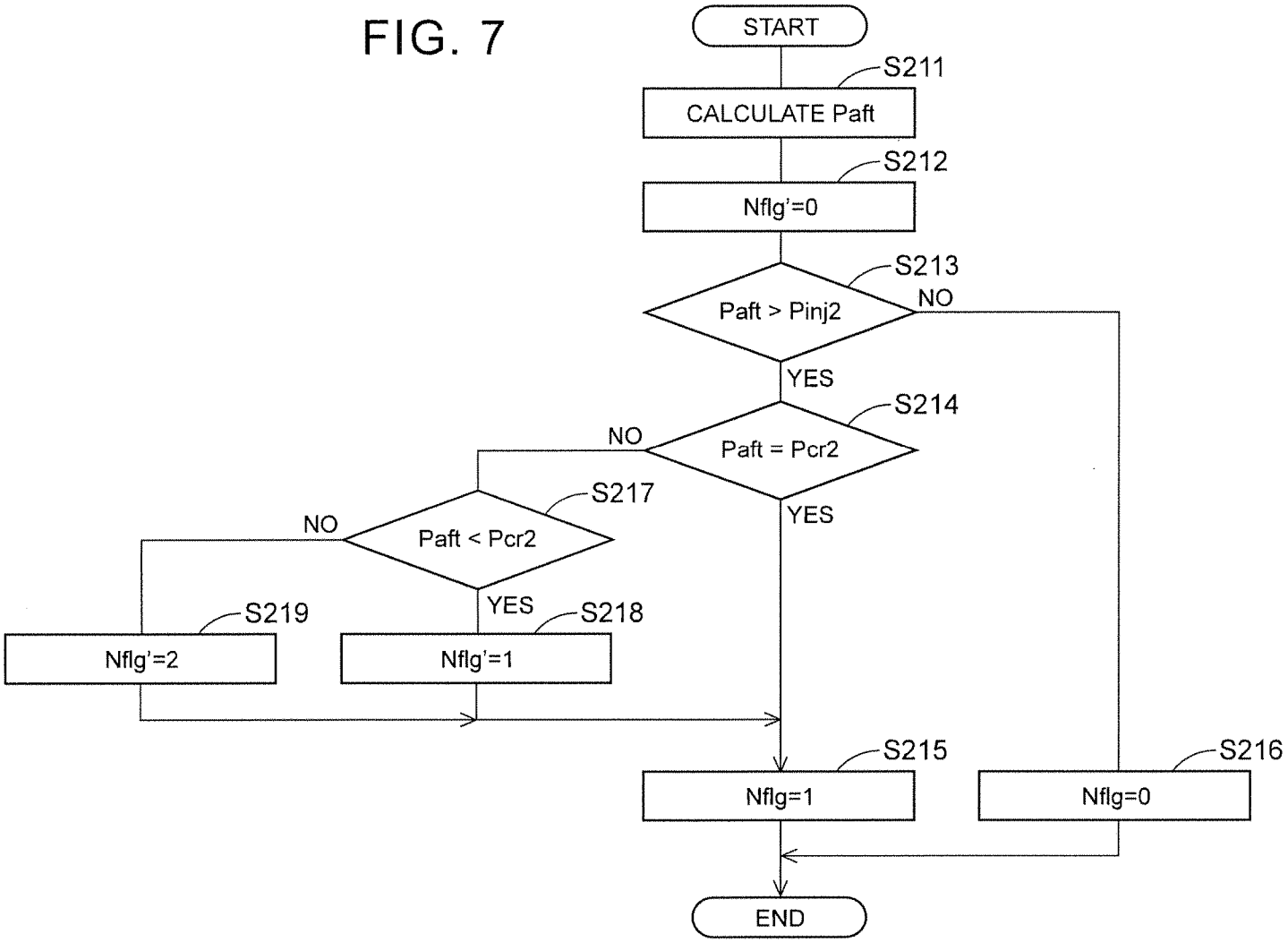
FIG. 7 is a flowchart illustrating a flow of setting a blank operation execution determination flag according to the first modified example of the first embodiment of the disclosure.

Here, the process of setting the blank operation execution determination flag Nflg in step S201 will be described based on FIG. 7. FIG. 7 is a flowchart illustrating the flow of setting the blank operation execution determination flag Nflg.

In the control flow shown in FIG. 7, the after injection pressure Paft is initially calculated in step S211. In the ROM of the ECU 10, the relationships between the after injection pressure Paft, and the engine speed Ne and the engine load KL, are stored in advance in the form of a map or a function. In step S211, the after injection pressure Paft is calculated, using the map or function. After execution of step S211, the fuel pressure control determination flag Nflg' is initialized to 0 in step S212. The fuel pressure control determination flag Nflg' is a flag based on which it is determined whether the normal after injection is executed, or the after injection after fuel pressure control is executed, in the after injection in step S204 above.

Then, it is determined in step S213 whether the after injection pressure Paft calculated in step S211 is smaller than the later fuel injection pressure Pinj2 calculated in the above step S105. If an affirmative decision (YES) is obtained in step S213, the after injection pressure Paft can be ensured even if the blank operation is performed; therefore, the blank operation can be executed, and the ECU 10 proceeds to step S214. If a negative decision (NO) is obtained in step S213, the after injection cannot be performed at the after injection pressure Paft if the reference pressure is reduced from the pre-reduction reference pressure Pcr to the post-reduction reference pressure Pcr2 through the blank operation; therefore, the blank operation cannot be executed, and the ECU 10 proceeds to step S216.

If an affirmative decision (YES) is obtained in step S213, it is then determined in step S214 whether the after injection pressure Paft calculated in step S211 is equal to the post-reduction reference pressure Pcr2 calculated in the above step S106. If an affirmative decision (YES) is obtained in step S214, the blank operation execution determination flag Nflg is set to 1 in step S215. As a result, it is determined in the above step S202 that the blank operation can be executed, and the blank operation is performed in the above step S110. After execution of step S215, the control flow shown in FIG. 7 ends. If an affirmative decision (YES) is obtained in step S214, the fuel pressure control determination flag Nflg' remains 0. Then, in the above step S204, the normal after injection is carried out, when the blank operation execution determination flag Nflg is 1, and the fuel pressure control determination flag Nflg' is 0.

If a negative decision (NO) is obtained in step S213, the blank operation execution determination flag Nflg is set to 0 in step S216. As a result, in the above step S202, it is determined that the blank operation cannot be executed (carried out), and the blank operation is not executed (carried out). Then, after execution of step S216, the (control) flow (routine) shown in FIG. 7 ends (is finished). At this time, too, the fuel pressure control determination flag Nflg' remains 0. Then, in the above step S206, the after injection is executed (carried out), when the blank operation execution determination flag Nflg is 0, and the fuel pressure control determination flag Nflg' is 0.

If a negative decision (NO) is obtained in step S214, it is determined in step S217 whether the after injection pressure Paft calculated in step S211 is smaller than the post-reduction reference pressure Pcr2 calculated in the above step S106. If an affirmative decision (YES) is obtained in step S217, the fuel pressure control determination flag Nflg' is set to 1 in step S218, and the ECU 10 then proceeds to step S215, in which the blank operation execution determination flag Nflg is set to 1. On the other hand, if a negative decision (NO) is obtained in step S217, the fuel pressure control determination flag Nflg' is set to 2 in step S219, and the ECU 10 then proceeds to step S215, in which the blank operation execution determination flag Nflg is set to 1. In this case, in the above step S204, when the blank operation execution determination Nflg is 1, and the fuel pressure control determination flag Nflg' is 1, the after injection after fuel pressure control is performed after the reference pressure is reduced to a pressure level lower than the post-reduction reference pressure Pcr2, as described above. When the blank operation execution determination flag Nflg is 1, and the fuel pressure control determination flag Nflg' is 2, the after injection after fuel pressure control is performed at the pressure increase ratio multiplied pressure that is higher than the post-reduction reference pressure Pcr2 as described above.

By executing the blank operation according to the control flow as described above, it is possible to suppress generation of smoke in the cylinder 2 in the initial stage of fuel injection, and minimize the cooling loss in the later stage of fuel injection, without affecting after injection.

Next, a second modified example of the first embodiment will be described. In the first embodiment, the pressure increasing device 320 is provided. In the second modified example, on the other hand, the pressure increasing device 320 is not provided. In the second modified example, substantially the same configuration and substantially the same control operation as those of the first embodiment will not be described in detail.

Figure 8:
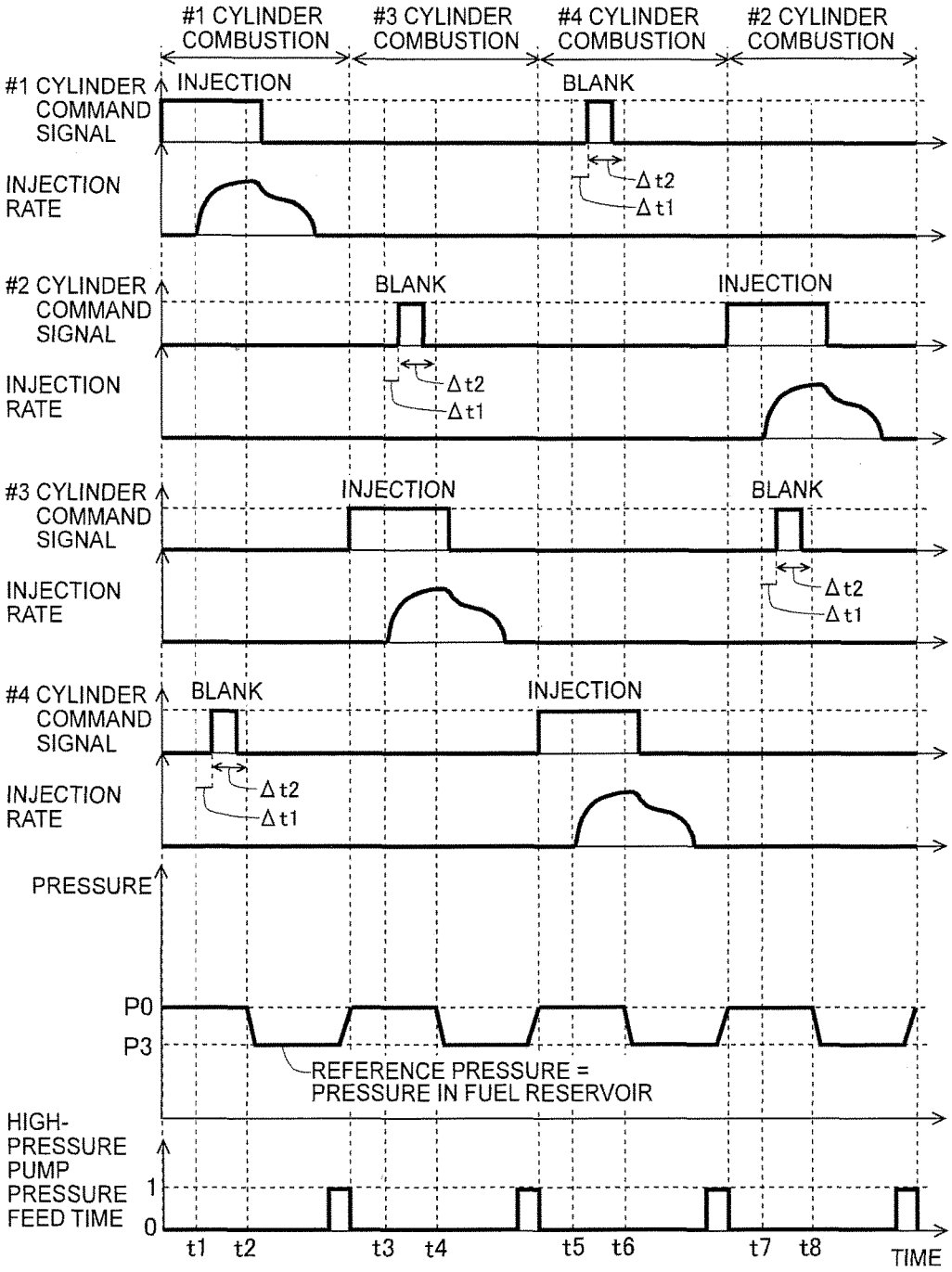
FIG. 8 is a view showing a time chart of the case where blank operation is performed according to a second modified example of the first embodiment of the disclosure.

A control process performed by the control system for the internal combustion engine 1 according to the modified example will be described in detail using a time chart shown in FIG. 8. In FIG. 8, changes of a command signal transmitted from the ECU 10 to the solenoid actuator 312A and the rate of fuel injection from the fuel injection valve 3 in each cylinder 2 with time are indicated in the order of #1 cylinder to #4 cylinder, as in FIG. 4 above. Further, changes of the fuel pressure in the fuel reservoir 304 of the first injection valve and the reference pressure with time, and the timing of fuel pressure feeding from the high-pressure pump 32 are indicated in FIG. 8.

In the control process shown in FIG. 8, initially, fuel injection from the fuel injection valve 3 provided in #1 cylinder (namely, the fuel injection valve 3 provided in #1 cylinder is one example of the first injection valve at this time) is started, on the combustion stroke of #1 cylinder. In this modified example in which the pressure increasing device 320 is not provided, the fuel pressure in the fuel reservoir 304 of the first injection valve is not increased before the start of fuel injection, unlike the control process shown in FIG. 4 above. Accordingly, at the start of fuel injection, the fuel pressure, or the fuel injection pressure, is the same pressure P0 as the reference pressure. Since the fuel injection rate of fuel injection by the first injection valve is reduced after time t2 due to blank operation that will be described later, the fuel injection rate is higher in the initial stage of fuel injection than that in the later stage.

During fuel injection by the first injection valve, the blank operation is executed upon a lapse of a predetermined period Δt1 from time t1 as the start time of the fuel injection by the first injection valve, in the same manner as that in the control process shown in FIG. 4 above. Then, as the reference pressure is reduced from pressure P0 to pressure P3 after time t2, namely, after a lapse of a given delay time Δt2 from the start of the blank operation, the fuel pressure in the fuel reservoir 304 of the first injection valve is also reduced from pressure P0 to pressure P3. As a result, the fuel injection rate during fuel injection by the first injection valve is reduced to a fuel injection rate corresponding to the fuel injection pressure P3. Then, after the fuel injection by the first injection valve is completed, the high-pressure pump 32 feeds the fuel under pressure into the common rail 31, so that the reference pressure recovers from the pressure P3 to the original pressure P0.

Then, on the combustion strokes of #3 cylinder, #4 cylinder, and #2 cylinder following the combustion stroke of #1 cylinder, the same control process as that as described above is performed.

With regard to a control flow executed by the control system for the engine 1 according to this modified example, steps that are different from those of the control flow shown in n FIG. 5 above will be described.

In the second modified example, in step S105 of the flow shown in FIG. 5 above, the initial fuel injection pressure Pinj1 is set to the pre-reduction reference pressure Pcr, and then, the later fuel injection pressure Pinj2 is calculated.

Also, in the second modified example, in step S106 of the flow shown in FIG. 5 above, the post-reduction reference pressure Pcr2 is calculated according to the following equation (5).

$$Pcr2=Pinj2 \tag{5}$$

The control system for the engine 1 according to the second modified example reduces the reference pressure during fuel injection by the first injection valve in the manner as described above, so as to realize fuel injection having the pattern of initial high injection rate and later low injection rate. In this manner, generation of smoke in the cylinder 2 in the initial stage of fuel injection can be suppressed, and further, the cooling loss in the later stage of fuel injection can be minimized.

Next, a second embodiment of the disclosure will be described based on FIG. 9 through FIG. 11. Here, substantially the same configuration and substantially the same control operation as those of the above first embodiment will not be described in detail.

In the first embodiment as described above, the reference pressure during fuel injection by the first injection valve is reduced, so that the fuel injection rate in the initial stage of fuel injection is reduced. Here, if the time of reduction of the fuel injection rate in the later stage of fuel injection can be controlled with improved accuracy, a cooling loss in the later stage of fuel injection can be more favorably reduced. Thus, the ECU 10 according to the second embodiment controls the start time of blank operation in the second injection valve, according to a distance between a first connecting portion as a connection portion between the fuel passage 33 that leads to the injection holes 301 of the first injection valve, and the common rail 31, and a second connecting portion as a connecting portion between the fuel passage 33 that leads to the injection holes 301 of the second injection valve, and the common rail 31. In the second embodiment, the ECU 10 controls the start time of blank operation in the second injection valve, and thus functions as one example of operation time control device according to the disclosure. In the following, the second embodiment will be described in detail, using a schematic view of a fuel injection system shown in FIG. 9, and a time chart shown in FIG. 10.

Figure 9:
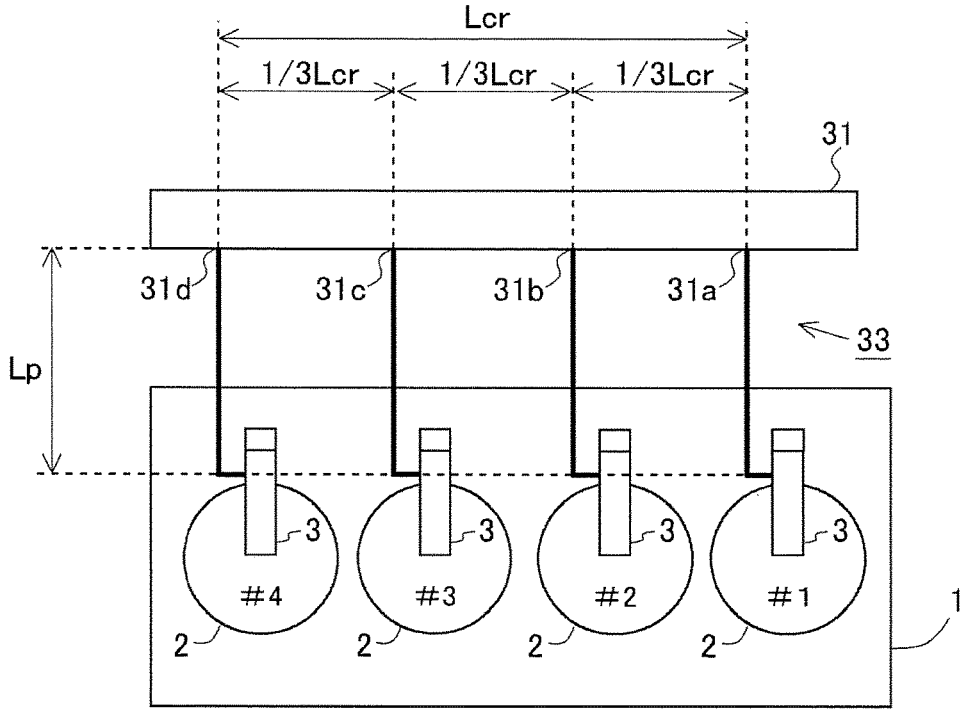
FIG. 9 is a view showing the positional relationship of fuel injection valves, common rail, and fuel passages according to a second embodiment of the disclosure.

FIG. 9 shows the positional relationship of the fuel injection valves 3, common rail 31, and the fuel passages 33. In FIG. 9, the connecting portion between the fuel passage 33 that leads to the fuel injection valve 3 provided in #1 cylinder and the common rail 31 is denoted as connecting portion 31*a*. Similarly, the connecting portion corresponding to the fuel injection valve 3 provided in #2 cylinder is denoted as connecting portion 31*b*, and the connecting portion corresponding to the fuel injection valve 3 provided in #3 cylinder is denoted as connecting portion 31*c*, while the connecting portion corresponding to the fuel injection valve 3 provided in #4 cylinder is denoted as connecting portion 31*d*. The length of the fuel passage 33 that connects the common rail 31 with each fuel injection valve 3 is the same length Lp. In the internal combustion engine 1, four cylinders 2 are arranged in series at equal intervals, in the order of #1 cylinder, #2 cylinder, #3 cylinder and #4 cylinder; therefore, the fuel injection valves 3 provided in the respective cylinders 2 are also located at positions corresponding to the cylinders 2. Namely, the length between the connecting portion 31*a* and the connecting portion 31*b* is one-third of length Lcr as the length between the connecting portion 31*a* and the connecting portion 31*d*. The length between the connecting portion 31*b* and the connecting portion 31*c*, and the length between the connecting portion 31*c* and the connecting portion 31*d* are also equal to ⅓Lcr.

Figure 10:
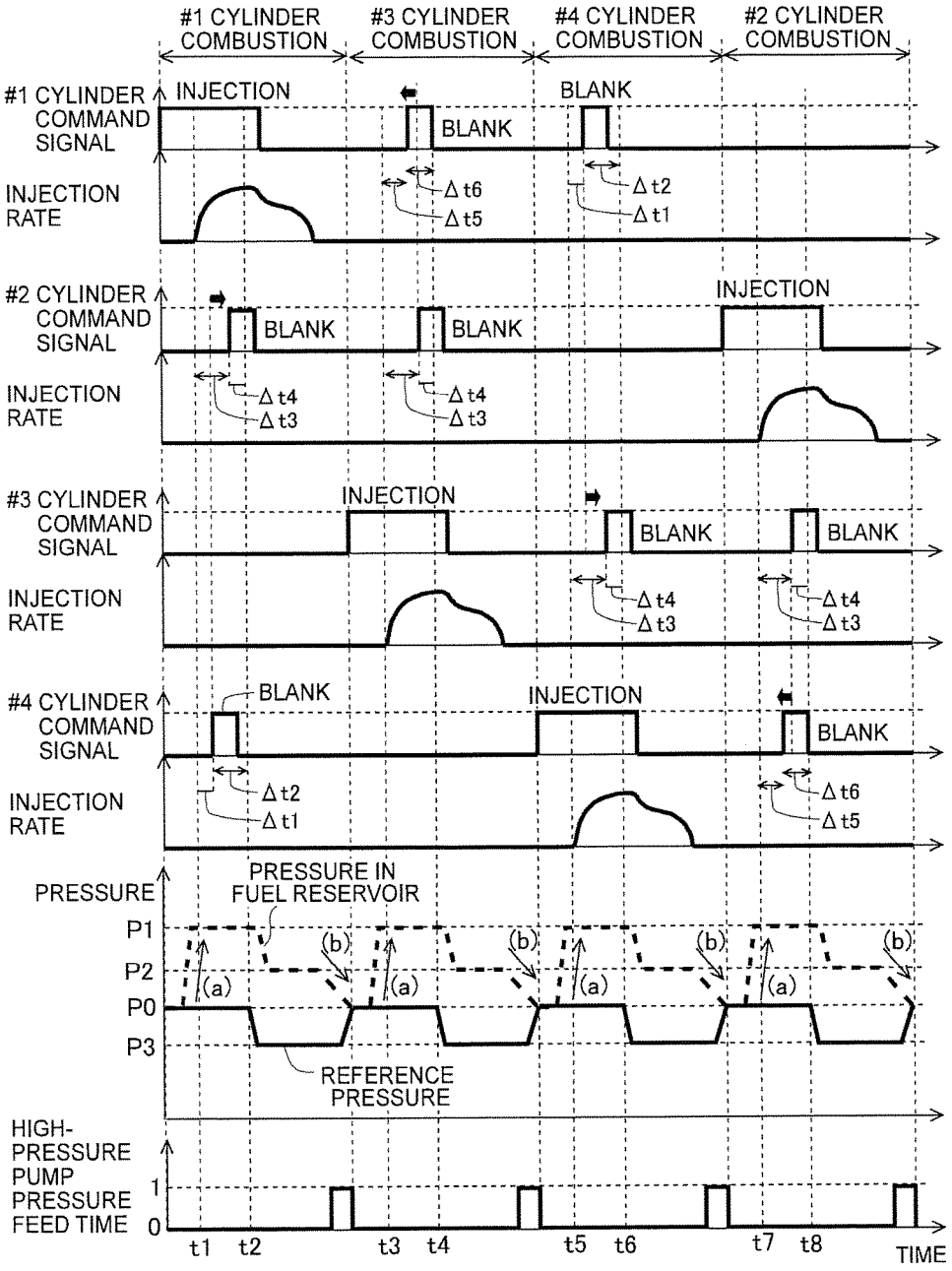
FIG. 10 is a time chart of the case where blank operation is performed according to the second embodiment of the disclosure.

In FIG. 10, changes of a command signal transmitted from the ECU 10 to the solenoid actuator 312A and the rate of fuel injection from the fuel injection valve 3 in each cylinder 2 with time are indicated in the order of #1 cylinder to #4 cylinder, as in FIG. 4 above. Further, changes of the fuel pressure in the fuel reservoir 304 of the first injection valve, and the reference pressure, and the timing of fuel pressure feeding from the high-pressure pump 32 are also indicated. In the time chart shown in FIG. 10, blank operation is performed in each of two second injection valves. Here, the blank operation is performed in a second injection valve provided in the reverse cylinder of the cylinder 2 in which the first injection valve is provided, and another second injection valve that is a fuel injection valve 3 different from the first injection valve and is provided in a certain cylinder 2 different from the reverse cylinder.

In the control process shown in FIG. 10, initially, on the combustion stroke of #1 cylinder, fuel injection from the fuel injection valve 3 provided in #1 cylinder (namely, the fuel injection valve 3 provided in #1 cylinder is one example of the first injection valve at this time) is started. Before the start of the fuel injection, the fuel pressure in the fuel reservoir 304 of the first injection valve is increased from pressure P0 to pressure P1 by means of the pressure increasing device 320 provided in the first fuel passage 33A that leads to the first injection valve, and the fuel injection pressure at the start of fuel injection is equal to pressure P1.

Then, during fuel injection by the first injection valve, and after a lapse of a predetermined period Δt1 from time t1 as the start time of fuel injection by the first injection valve, a command signal for blank operation is transmitted to the solenoid actuator 312A in the fuel injection valve 3 provided in #4 cylinder that is the reverse cylinder of #1 cylinder in which the first injection valve is provided (namely, the fuel injection valve 3 provided in #4 cylinder is one example of the second injection valve). Also, during fuel injection by the first injection valve, and after a lapse of a predetermined period Δt3 from time t1, a command signal for blank operation is transmitted to the solenoid actuator 312A in the fuel injection valve 3 that is different from the first injection valve, and is provided in #2 cylinder that is different from the reverse cylinder (namely, the fuel injection valve 3 provided in #2 cylinder is also one example of the second injection valve).

At this time, a distance between the first injection valve and the second injection valve via the fuel passages 33 and the common rail 31 is expressed as follows, with reference to FIG. 9; namely, the distance between the first injection valve and the fuel injection valve 3 provided in #4 cylinder is 2·Lp+Lcr, and the distance between the first injection valve and the fuel injection valve 3 provided in #2 cylinder is 2·Lp+1/3Lcr. Here, if the blank operation is started at the same time, the fuel injection rate starts being reduced at an earlier point in time when the distance between the first injection valve and the second injection valve is relatively short, than that when the distance is relatively long. Also, even in the case where blank operation is performed by two or more second injection valves, it is desirable that the reduction of the fuel injection rate due to the blank operation starts at the same time. Accordingly, if the second injection valve provided in #4 cylinder as the reverse cylinder is considered as a reference second injection valve, the predetermined period Δt3 associated with the start time of blank operation in the second injection valve provided in #2 cylinder is set to be longer than the predetermined period Δt1 associated with the start time of blank operation in the second injection valve provided in #4 cylinder as the reference second injection valve, in the control process shown in FIG. 10. Namely, the start time of blank operation is delayed, in the second injection valve provided in #2 cylinder having the shorter distance relative to the first injection valve, as compared with the second injection valve provided in #4 cylinder as the reference second injection valve. Here, one example of the first connecting portion according to the disclosure is the connecting portion 31*a* shown in FIG. 9 above. Then, one example of the second connecting portion according to the disclosure is the connecting portion 31*d* corresponding to #4 cylinder as the reference cylinder, and one example of the second connecting portion is the connecting portion 31*b* corresponding to #2 cylinder. In other words, since the distance ⅓Lcr between the connecting portion 31*a* as the first connecting portion and the connecting portion 31*b* corresponding to #2 cylinder is shorter than the distance Lcr between the connecting portion 31*a* and the connecting portion 31*d* corresponding to #4 cylinder, the start time of blank operation is delayed, in the second injection valve provided in #2 cylinder. Thus, the time at which a given delay time Δt4 has elapsed from the start of blank operation in the second injection valve provided in #2 cylinder is the same point in time t2 as the time at which a given delay time Δt2 has elapsed from the start of blanking operation in the second injection valve provided in #4 cylinder as the reference cylinder.

As the reference pressure is reduced from pressure P0 to pressure P3 after time t2, the fuel pressure in the fuel reservoir 304 of the first injection valve is reduced from pressure P1 to pressure P2. As a result, the fuel injection rate during fuel injection by the first injection valve is reduced to a fuel injection rate corresponding to the fuel injection pressure P2.

Then, in the control process shown in FIG. 10, fuel injection from the fuel injection valve 3 provided in #3 cylinder (namely, the fuel injection valve 3 provided in #3 cylinder is one example of the first injection valve) is started at time t3, on the combustion stroke of #3 cylinder. Then, after a lapse of the predetermined period Δt3 from time t3, a command signal for blank operation is transmitted to the solenoid actuator 312A in the fuel injection valve 3 provided in #2 cylinder as the reverse cylinder of #3 cylinder in which the first injection valve is provided (namely, the fuel injection valve 3 provided in #2 cylinder is one example of the second injection valve). Also, after a lapse of a predetermined period Δ5 from time t3, a command signal for blank operation is transmitted to the solenoid actuator 312A in the fuel injection valve 3 that is different from the first injection valve, and is provided in #1 cylinder that is different from the reverse cylinder (namely, the fuel injection valve 3 provided in #1 cylinder is also one example of the second injection valve).

At this time, the distance between the first injection valve and the second injection valve via the fuel passages 33 and the common rail 31 is expressed with reference to FIG. 9, such that the distance between the first injection valve and the fuel injection valve 3 provided in #2 cylinder is 2·Lp+⅓Lcr, and the distance between the first injection valve and the fuel injection valve 3 provided in #1 cylinder is 2·Lp+⅔Lcr. Accordingly, if the second injection valve provided in #2 cylinder as the reverse cylinder is considered as a reference second injection valve, the predetermined period Δt5 associated with the start time of blank operation in the second injection valve provided in #1 cylinder is set to be longer than the predetermined period Δt3 associated with the start time of blank operation in the second injection valve provided in #2 cylinder as the reference second injection valve, in the control process shown in FIG. 10. Namely, the start time of blank operation is advanced, in the second injection valve provided in #1 cylinder having the longer distance from the first injection valve, as compared with the second injection valve provided in #2 cylinder as the reference second injection valve. Thus, the time at which a given delay time 46 has elapsed from the start of blank operation in the second injection valve provided in #1 cylinder is the same point in time t4 as the time at which a given delay time Δt4 has elapsed from the start of blanking operation in the second injection valve provided in #2 cylinder as the reference cylinder. As the reference pressure is reduced from pressure P0 to pressure P3 after time t4, the fuel pressure in the fuel reservoir 304 of the first injection valve is reduced from pressure P1 to pressure P2. As a result, the fuel injection rate during fuel injection by the first injection valve is reduced to a fuel injection rate corresponding to the fuel injection pressure P2.

Then, on the combustion strokes of #4 cylinder and #2 cylinder following the combustion stroke of #3 cylinder, substantially the same control process as that as described above is performed.

Here, a control flow executed by the control system for the internal combustion engine 1 according to the second embodiment will be described based on FIG. 11. FIG. 11 is a flowchart illustrating the control flow, in the control system for the engine 1 according to the second embodiment. In the second embodiment, the ECU 10 repeatedly executes the control flow of FIG. 11 at given computation intervals during operation of the engine 1.

Figure 11:
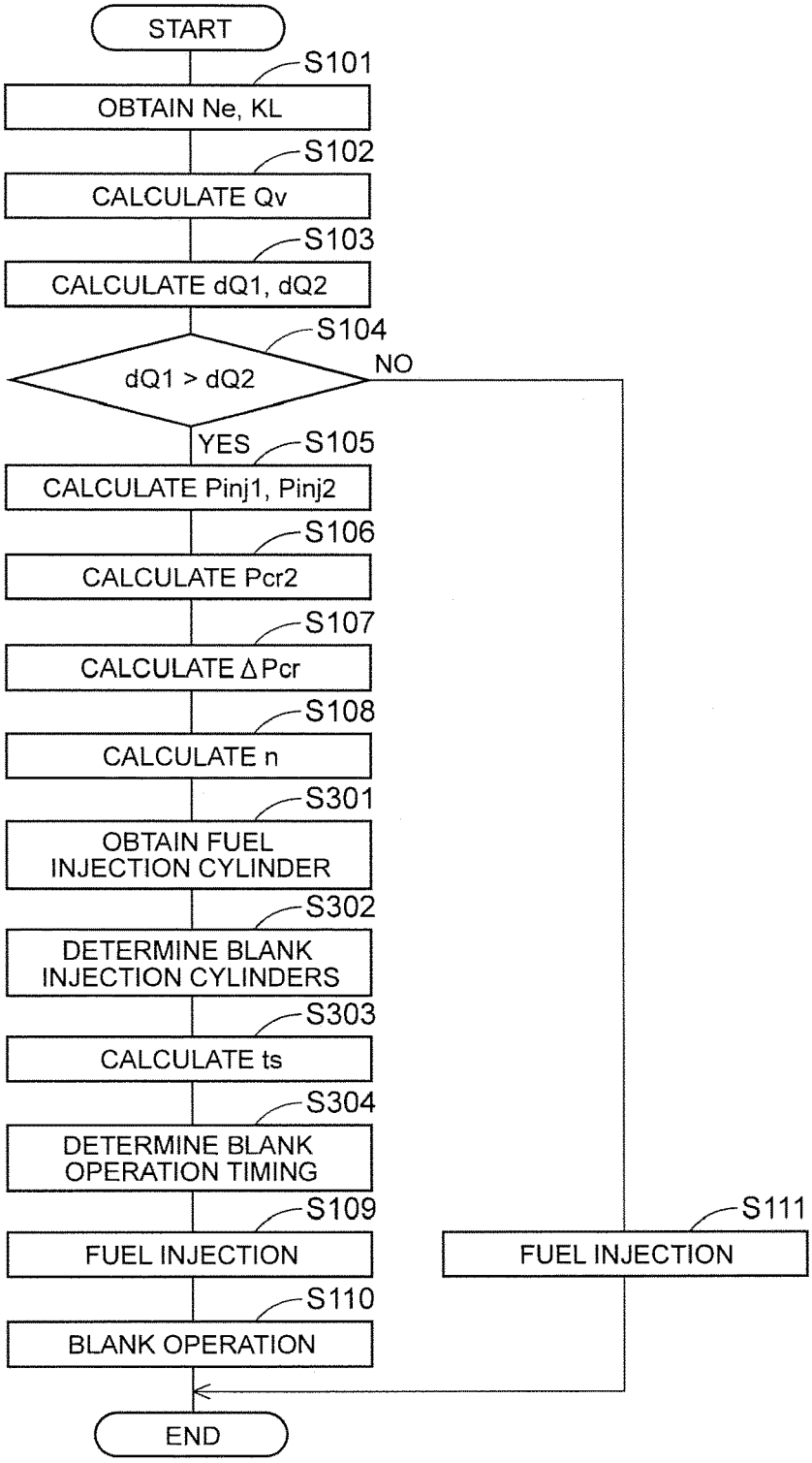
FIG. 11 is a flowchart illustrating a control flow executed by a control system for an internal combustion engine according to the second embodiment of the disclosure.

In the control flow shown in FIG. 11, after execution of step S108, a fuel injection cylinder as a cylinder 2 in which fuel injection is performed is obtained in step S301. The fuel injection valve 3 provided in the fuel injection cylinder obtained in step S301 provides the first injection valve.

Then, in step S302, blank injection cylinders each of which is a cylinder 2 in which the fuel injection valve 3 that performs blank operation is provided are determined in step S302. As shown in FIG. 10 above, for example, in step S302, when the fuel injection cylinder is #1 cylinder, the blank injection cylinders are #4 cylinder as the reverse cylinder of #1 cylinder, and #2 cylinder that is a certain cylinder 2 that is different from #4 cylinder as the reverse cylinder of #1 cylinder as the fuel injection cylinder. Also, when the fuel injection cylinder is #2 cylinder, the blank injection cylinders are #3 cylinder as the reverse cylinder of #2 cylinder, and #4 cylinder as a certain cylinder 2 that is different from #3 cylinder as the reverse cylinder of #2 cylinder as the fuel injection cylinder. Also, when the fuel injection cylinder is #3 cylinder, the blank injection cylinders are #2 cylinder as the reverse cylinder of #3 cylinder, and #1 cylinder as a certain cylinder 2 that is different from #2 cylinder as the reverse cylinder of #3 cylinder as the fuel injection cylinder. Also, when the fuel injection cylinder is #4 cylinder, the blank injection cylinders are #1 cylinder as the reverse cylinder of #4 cylinder, and #3 cylinder as a certain cylinder 2 that is different from #1 cylinder as the reverse cylinder of #4 cylinder as the fuel injection cylinder. Then, the fuel injection valves 3 provided in the blank injection cylinders determined in step S302 provide the second injection valves.

Then, in step S303, the fuel injection rate switching time ts is calculated. In step S303, the fuel injection rate switching time ts is calculated using a map or a function stored in the ROM of the ECU 10, in the same manner as that of calculation of the initial fuel injection rate dQ1 and the later fuel injection rate dQ2 as described above.

Next, in step S304, the start time of blank operation is determined. In step S304, the start time of blank operation is determined, based on the fuel injection rate switching time ts calculated in step S303, and the distance between the first injection valve and the second injection valve via the fuel passages 33 and the common rail 31. As indicated in FIG. 10 above, for example, when the fuel injection cylinder is #1 cylinder, the start time of blank operation is delayed, in the second injection valve provided in #2 cylinder having the shorter distance from the first injection valve, as compared with the second injection valve (reference second injection valve) provided in #4 cylinder as the reverse cylinder. Also, when the fuel injection cylinder is #2 cylinder, the start time of blank operation is advanced, in the second injection valve provided in #4 cylinder having the longer distance from the first injection valve, as compared with the second injection valve (reference second injection valve) provided in #3 cylinder as the reverse cylinder. Also, when the fuel injection cylinder is #3 cylinder, the start time of blank operation is advanced, in the second injection valve provided in #1 cylinder having the longer distance from the first injection valve, as compared with the second injection valve (reference second injection valve) provided in #2 cylinder as the reverse cylinder. Also, when the fuel injection cylinder is #4 cylinder, the start time of blank operation is delayed, in the second injection valve provided in #3 cylinder having the shorter distance from the first injection valve, as compared with the second injection valve (reference second injection valve) provided in #1 cylinder as the reverse cylinder.

Then, after execution of step S304, the ECU 10 proceeds to step S109, in which fuel injection from the first injection valve is performed. Then, in step S110, the blank operation is executed at the start time of blank operation determined in step S304 with respect to each of the second injection valves.

The control system for the engine 1 according to the second embodiment makes it possible to control the time of reduction of the fuel injection rate in the later stage of fuel injection with improved accuracy, by carrying out the blank operation in the manner as described above. Consequently, the cooling loss in the later stage of fuel injection can be more favorably reduced.

What is claimed is:

1. A control system for an internal combustion engine including:

a plurality of cylinders;

a plurality of fuel injection valves provided in the plurality of cylinders respectively, each of the plurality of fuel injection valves being configured to directly inject a fuel into a corresponding one of the cylinders by moving a needle and opening injection holes;

a high-pressure pump configured to increase a pressure of the fuel and feed the fuel under pressure;

a common rail configured to store the fuel, a reference pressure of the fuel being increased by the high-pressure pump;

a plurality of fuel passages provided independently of each other, each of the fuel passages extending from the common rail to the injection holes of a corresponding one of the plurality of fuel injection valves; and a control chamber provided in each of the plurality of fuel injection valves, the control chamber being connected to a corresponding one of the fuel passages which leads to the injection holes of the corresponding fuel injection valve, the control system comprising an electronic control unit configured to:

(i) reduce a pressure of the fuel in the control chamber to be lower than a pressure of the fuel in the fuel passage connected to the control chamber, in each of the plurality of fuel injection valves, (ii) move the needle in a direction to open the injection holes by reducing the pressure of the fuel such that a first pressure difference as a pressure difference between the pressure of the fuel in the control chamber and the pressure of the fuel in the fuel passage connected to the control chamber is equal to or larger than a predetermined pressure difference, in each of the plurality of fuel injection valves, so as to move the needle in a direction to open the injection holes, and (iii) reduce the reference pressure by executing pressure reducing operation in a second injection valve, such that the first pressure difference after executing the reference pressure reducing operation is smaller than the predetermined pressure difference during fuel injection by a first injection valve, and after a lapse of a predetermined period from start of fuel injection by the first injection valve, the first injection valve being one of the plurality of the fuel injection valves which is currently injecting the fuel, the second injection valve being at least one of the plurality of fuel injection valves which is different from the first injection valve.

2. The control system according to claim 1, further comprising:

a first connecting portion configured to connect the fuel passage that leads to the injection holes of the first injection valve, with the common rail; and a second connecting portion configured to connect the fuel passage that leads to the injection holes of the second injection valve, with the common rail, wherein the electronic control unit is configured to:

(i) control start time of the pressure reducing operation in the second injection valve, according to a distance between the first connecting portion and the second connecting portion, and (ii) delay the start time of the pressure reducing operation, to be later when the distance between the first connecting portion and the second connecting portion is shorter, than that when the distance between the first connecting portion and the second connecting port is longer.

3. The control system according to claim 1, further comprising:

a pressure increasing device provided in each of the plurality of fuel passages, the pressure increasing device being configured to increase the pressure of the fuel supplied from the common rail to a corresponding one of the plurality of fuel injection valves.

* * * * *